US011041355B2

(12) United States Patent
Hogan et al.

(10) Patent No.: US 11,041,355 B2
(45) **Date of Patent: *Jun. 22, 2021**

(54) LUBRICATOR SYSTEM AND METHOD OF USE

(71) Applicant: THE JLAR GROUP, LTD, New Braunfels, TX (US)

(72) Inventors: Richard Joel Hogan, New Braunfels, TX (US); Santiago Jaime De Los Santos, New Braunfels, TX (US)

(73) Assignee: THE JLAR GROUP, LTD, New Braunfels, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/925,835

(22) Filed: Jul. 10, 2020

(65) Prior Publication Data

US 2020/0340325 A1 Oct. 29, 2020

Related U.S. Application Data

(63) Continuation of application No. 16/549,041, filed on Aug. 23, 2019, now Pat. No. 10,711,557, which is a continuation of application No. 16/044,061, filed on Jul. 24, 2018, now Pat. No. 10,392,893.

(60) Provisional application No. 62/563,855, filed on Sep. 27, 2017.

(51) Int. Cl.

| | |
|---|---|
| ***E21B 33/068*** | (2006.01) |
| *E21B 43/116* | (2006.01) |
| *E21B 33/12* | (2006.01) |
| *E21B 33/072* | (2006.01) |

(52) U.S. Cl.

CPC ..... *E21B 33/068* (2013.01); *E21B 33/072* (2013.01); *E21B 33/12* (2013.01); *E21B 43/116* (2013.01)

(58) Field of Classification Search

CPC ..... E21B 19/22; E21B 33/068

See application file for complete search history.

(56) References Cited

U.S. PATENT DOCUMENTS

| | | | | |
|---|---|---|---|---|
| 10,392,893 | B2 * | 8/2019 | Hogan | E21B 33/068 |
| 10,711,557 | B2 * | 7/2020 | Hogan | E21B 33/068 |
| 2011/0073299 | A1 * | 3/2011 | Havinga | E21B 19/22 166/77.2 |
| 2016/0138347 | A1 * | 5/2016 | Bjornenak | E21B 19/22 166/66 |

* cited by examiner

*Primary Examiner* — Kristyn A Hall

(74) *Attorney, Agent, or Firm* — Haynes and Boone, LLP

(57) ABSTRACT

A lubricator system according to which a lubricator defines an internal passage that extends along a curvilinear path. The lubricator is configured to be connected to a wellhead at the top or head of an oil and gas wellbore. A downhole tool is configured to be conveyed through the internal passage of the lubricator and along the curvilinear path in combination with a conveyance string connected to the downhole tool. The downhole tool may be, include, or be part of, for example, a perforating gun.

26 Claims, 30 Drawing Sheets

LUBRICATOR SYSTEM AND METHOD OF USE

CROSS-REFERENCE TO RELATED APPLICATIONS

This application is a continuation of U.S. application Ser. No. 16/549,041, filed Aug. 23, 2019, the entire disclosure of which is hereby incorporated herein by reference.

U.S. application Ser. No. 16/549,041 is a continuation of U.S. application Ser. No. 16/044,061, filed Jul. 24, 2018, the entire disclosure of which is hereby incorporated herein by reference.

U.S. application Ser. No. 16/044,061 claims the benefit of the filing date of, and priority to, U.S. Application No. 62/563,855, filed Sep. 27, 2017, the entire disclosure of which is hereby incorporated herein by reference.

TECHNICAL FIELD

The present disclosure relates generally to oil and gas exploration and production operations, and, more particularly, to a lubricator system used during, for example, "plug-and-perf" completions operations.

BACKGROUND

In oil or gas exploration and production operations, a lubricator system may be connected to a wellhead at the top or head of a wellbore that traverses one or more subterranean formations. The lubricator system facilitates rapid access to a vertical, inclined, or horizontal portion of the wellbore using a downhole tool at the end of a wireline. The wireline extends from a wireline truck at the surface and into a lubricator connected to the wellhead, which lubricator is adapted to seal around the wireline to hold backpressure as fluid is communicated into the lubricator behind the downhole tool. The fluid communicated into the lubricator propels the downhole tool to the vertical, inclined, or horizontal portion of the wellbore. In many cases, the lubricator extends vertically along a straight path far above the wellhead, and may require a crane to support the lubricator in position. However, it is difficult and costly to properly set up the crane and to suspend the lubricator in position above the wellhead. Frequently, operations cannot begin, or must be stopped, so that the crane may be lowered as a safety precaution, especially if the wind exceeds certain windspeed limits. Therefore, what is needed is an apparatus, system, or method to address one or more of the foregoing issues, and/or one or more other issues.

DETAILED DESCRIPTION

Figure 1:
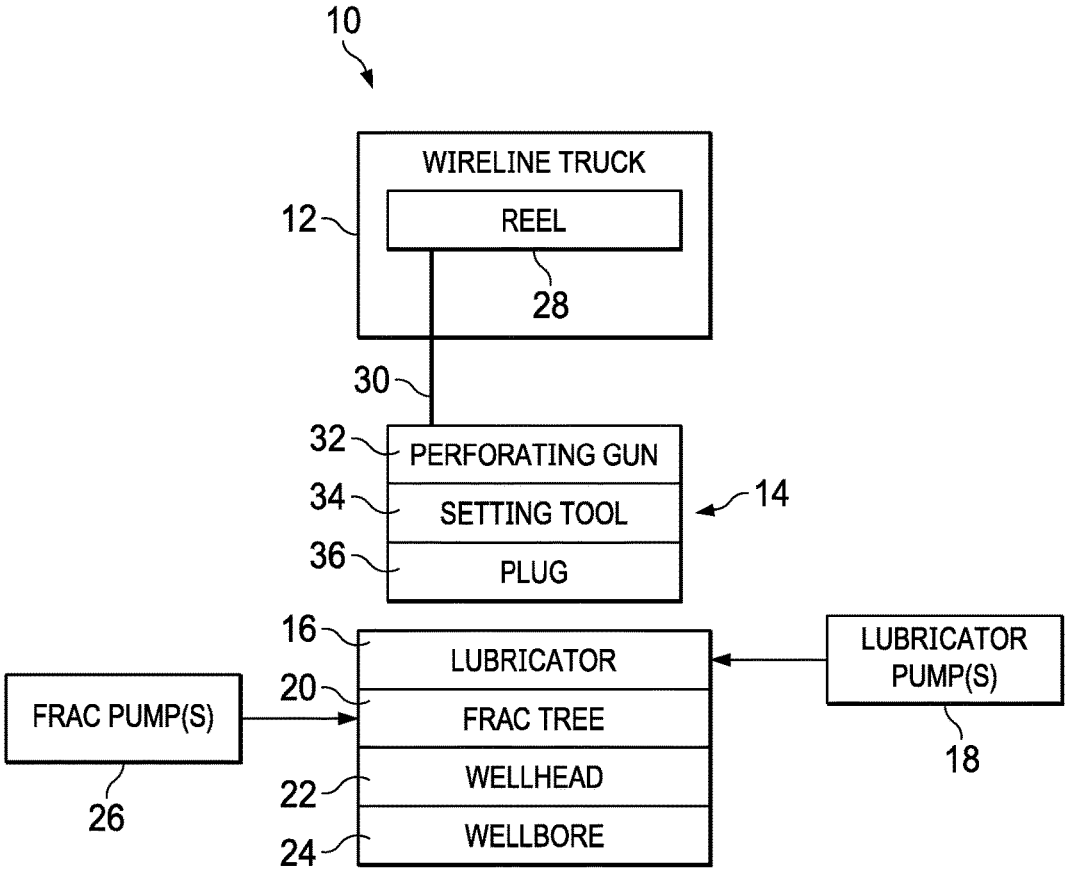
FIG. 1 is a diagrammatic illustration of a lubricator system including a lubricator, a downhole tool, and lubricator pumps, the lubricator system being connected to a fracturing tree, which is connected to a wellhead located at the top or head of an oil and gas wellbore, according to one or more embodiments of the present disclosure.
Figure 2:
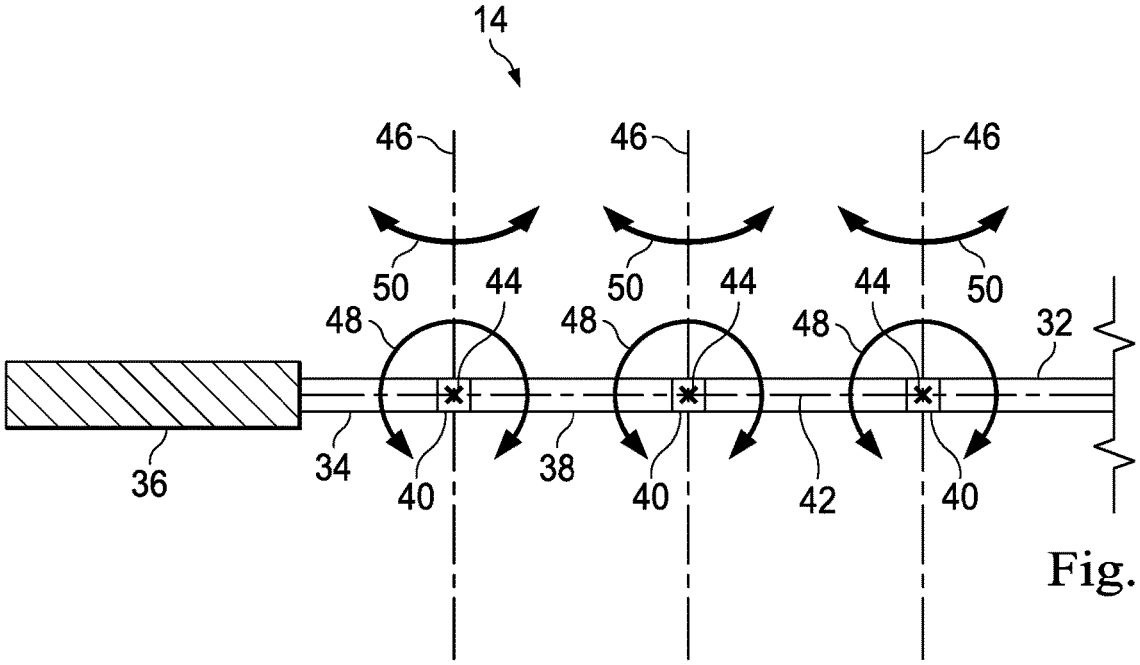
FIG. 2 is a schematic view of an embodiment of the downhole tool of FIG. 1, the downhole tool including a perforating gun, a setting tool, and a plug, according to one or more embodiments of the present disclosure.
Figure 3:
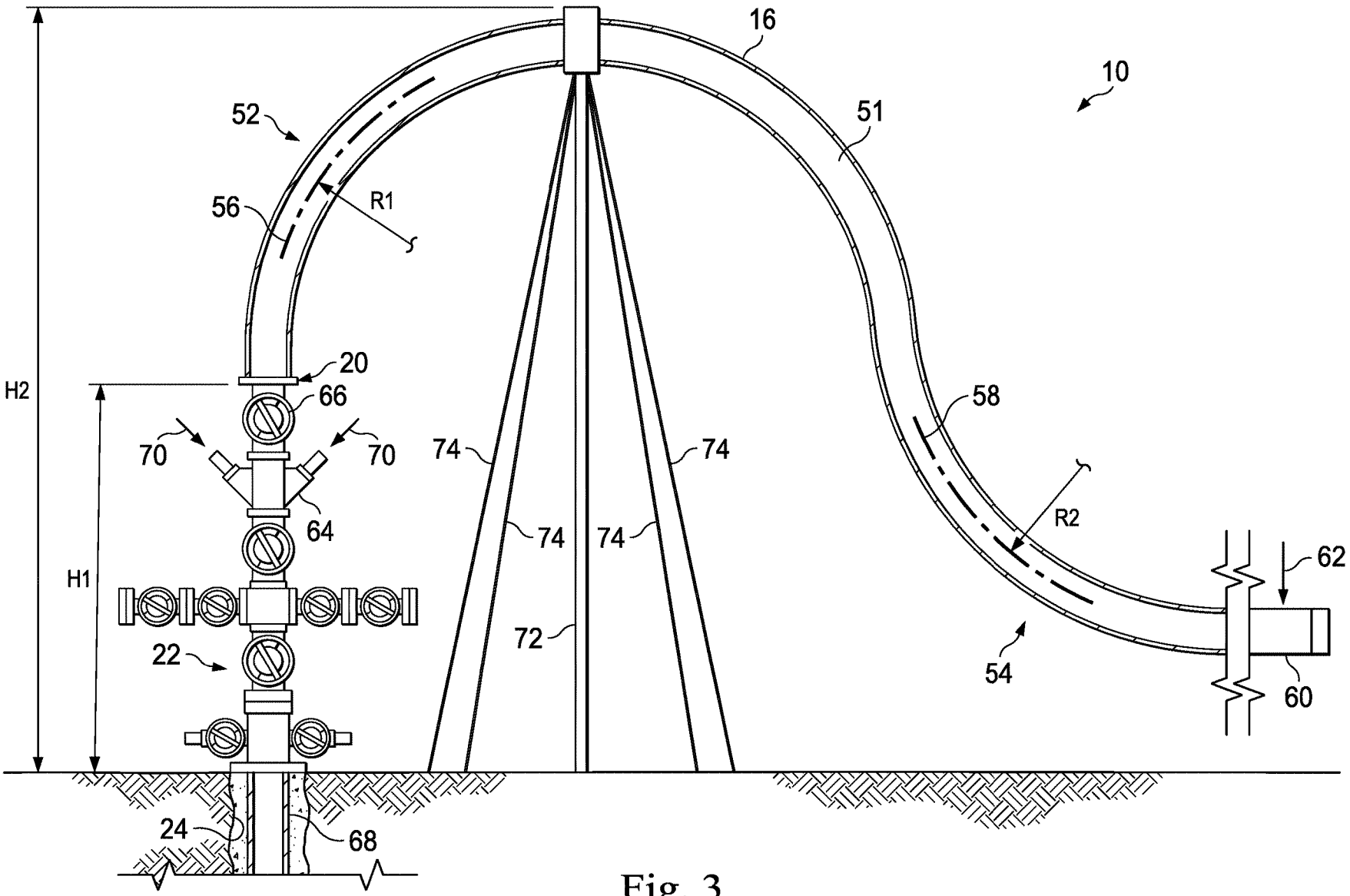
FIG. 3 is an elevational/schematic view of the fracturing tree, the wellhead, and an embodiment of the lubricator of FIG. 1, the lubricator including a downwardly concave section and an upwardly concave section, according to one or more embodiments of the present disclosure.

Referring to FIGS. 1-3, a lubricator system is generally referred to by the reference numeral 10 and includes a conveyance truck 12, a downhole tool 14, a lubricator 16, and lubricator pumps 18—the lubricator system 10 is shown diagrammatically in FIG. 1. The lubricator 16 is connected to a fracturing (or "frac") tree 20. The frac tree 20 is connected to a wellhead 22 opposite the lubricator 16. In some embodiments, the frac tree 20 is, includes, or is part of the wellhead 22. The wellhead 22 is located at the top or head of an oil and gas wellbore 24 that penetrates one or more subterranean formations and is used in oil and gas exploration and production operations. The lubricator 16 is connected to, and adapted to be in fluid communication with, the lubricator pump(s) 18. Similarly, the frac tree 20 is connected to, and adapted to be in fluid communication with, frac pump(s) 26. The conveyance truck 12 includes a reel 28 on which a conveyance string 30 is coiled. The conveyance string 30 may be any type of conveyance string capable of being connected to the downhole tool 14 and conveyed together therewith through the lubricator 16 to the wellbore 24—such conveyance strings may include, but are not limited to, casing, drill pipe, coiled tubing, production tubing, other types of pipe or tubing strings, and/or other types of conveyance strings, such as wireline, slickline, or the like. For example, in some embodiments, the conveyance string 30 is wireline and the conveyance truck 12 is a wireline truck. For another example, in some embodiments, the conveyance string 30 is coiled tubing and the conveyance truck 12 is a coiled tubing tuck.

The conveyance string 30 is connected to the downhole tool 14 opposite the reel 28. The downhole tool 14 includes a perforating gun 32, a setting tool 34 connected to the perforating gun 32, and a plug 36 connected to the setting tool 34. The downhole tool 14 is adapted to traverse the lubricator 16, the frac tree 20, the wellhead 22, and the wellbore 24 to perform a "plug-and-perf" operation, as will be described in further detail below. However, although described herein as including the perforating gun 32, the setting tool 34, and the plug 36 for use during a "plug-and-perf" operation, the downhole tool 14 may instead be another type of downhole tool for use in connection with another lubricator application—such an application may include, but is not limited to, drilling, completions, measurement, logging, or the like.

Turning to FIG. 2, an embodiment of the downhole tool 14 is shown in which the perforating gun 32 includes interconnected perforator segments 38 and pivot joints 40 extending along a longitudinal axis 42. The perforator segments 38 include explosive charges (not shown) adapted to perforate the wellbore 24 as part of the "plug-and-perf" operation, as will be described in further detail below. In addition to, or instead of, the explosive charges, the perforator segments 38 may include other components adapted to perforate the wellbore 24, such as, for example, hydraulic jets or the like. Before the wellbore 24 is perforated by the perforating gun 32, the setting tool 34 is adapted to set the plug 36 in the wellbore 24 as part of the "plug-and-perf" operation, as will be described in further detail below. Most of the pivot joints 40 are interposed between respective ones of the perforating gun 32's perforator segments 38—but at least one of the pivot joints 40 is interposed between the perforating gun 32 and the setting tool 34.

The pivot joints 40 permit pivoting of the perforator segments 38 relative to one another, and pivoting of the setting tool 34 relative to the perforating gun 32. More particularly, the pivot joints 40 each permit pivoting about a pair of axes 44 and 46, as indicated by curvilinear arrows 48 and 50, respectively. The axes 44 and 46 are spaced in a substantially perpendicular relation with one another. Moreover, the longitudinal axis 42 extends in a substantially perpendicular relation to the axes 44 and 46. In addition to, or instead of, permitting pivoting about the axes 44 and 46, the pivot joints 40 may be adapted to permit pivoting about one or more additional axes perpendicular to the longitudinal axis 42, and/or about the longitudinal axis 42 itself. In those embodiments in which the downhole tool 14 is omitted in favor of another downhole tool, pivot joints analogous to the pivot joints 40 may be incorporated into such a downhole tool to enable similar pivotability. Moreover, although described herein as including pivot joints, other downhole tools are contemplated that include flexible portions instead (or in addition) to enable similar pivotability. In some embodiments, the downhole tool 14 (or another downhole tool) includes other components, such as, for example, a collar counter, a measurement tool, a logging tool, or the like.

Turning to FIG. 3, an embodiment of the lubricator 16 is shown in which the lubricator 16 is a tubular member defining an internal passage 51 and including a downwardly concave section 52 and an upwardly concave section 54. The downwardly concave section 52 extends along a curvilinear axis 56 defining a radius R1, and the upwardly concave section 54 extends along a curvilinear axis 58 defining a radius R2. In some embodiments, the radius R2 is substantially equal to the radius R1. In some embodiments, the curvilinear axes 56 and 58 each extend within a single plane. In some embodiments, the curvilinear axes 56 and 58 are co-planar. In some embodiments, the axis 56 at least partially forms or defines a curvilinear path along which the internal passage 51 of the lubricator extends. In some embodiments, the axis 58 at least partially forms or defines the curvilinear path along which the internal passage 51 of the lubricator 16 extends. In some embodiments, the axes 56 and 58 at least partially form or define the curvilinear path along which the internal passage 51 of the lubricator 16 extends. The term "curvilinear path," as used herein, refers to any path whose traversal produces both vertical and horizontal movement, including, for example, a path having a plurality of straight segments angled relative to one another.

The downwardly concave section 52 is connected to the frac tree 20. The upwardly concave section 54 is connected to the downwardly concave section 52 opposite the frac tree 20. The lubricator pump(s) 18 are connected to, and adapted to be in fluid communication with, an end portion 60 of the lubricator 16 opposite the frac tree 20, as indicated by arrow 62. However, rather than being connected to the end portion 60 of the lubricator 16, the lubricator pump(s) 18 may be connected elsewhere to the lubricator 16. Moreover, although described herein as including the radii R1 and R2, the curvilinear axes 56 and 58 of the lubricator 16 may instead extend along another curvilinear path—such a path need not be limited to an arc or any other similarly curved shape. In some embodiments, the curvilinear axis 58 may be omitted in favor of another axis such as, for example, a horizontally-extending linear axis so that the curvilinear path extends along the linear axis and the curvilinear axis 56; in some embodiments, this linear axis and the curvilinear axis 56 at least partially form or define the curvilinear path along which the internal passage 51 of the lubricator 16 extends.

The frac tree 20 includes a goat head 64 and a swab valve 66. The goat head 64 is connected to the wellhead 22. The swab valve 66 is connected to the goat head 64 opposite the wellhead 22. The wellhead 22 is connected to a casing string 68 that traverses at least part of the wellbore 24. The frac pump(s) 26 are connected to, and adapted to be in fluid communication with, the goat head 64, as indicated by arrows 70. The frac tree 20 has a maximum height H1 measured from the ground to the top of the swab valve 66. The lubricator 16 has a maximum height H2 measured from the ground to the top of the downwardly concave section 52. In some embodiments, the height H2 is equal to, or less than, double the height H1. In some embodiments, a lubricator support rod 72 engages the downwardly concave section 52 to support the lubricator 16 at the maximum height H2. The lubricator support rod 72 is stabilized by guide wires 74. However, other types of supports are contemplated to support the lubricator 16 at the maximum height H2, such as, for example, scaffolding or the like.

Figure 4:
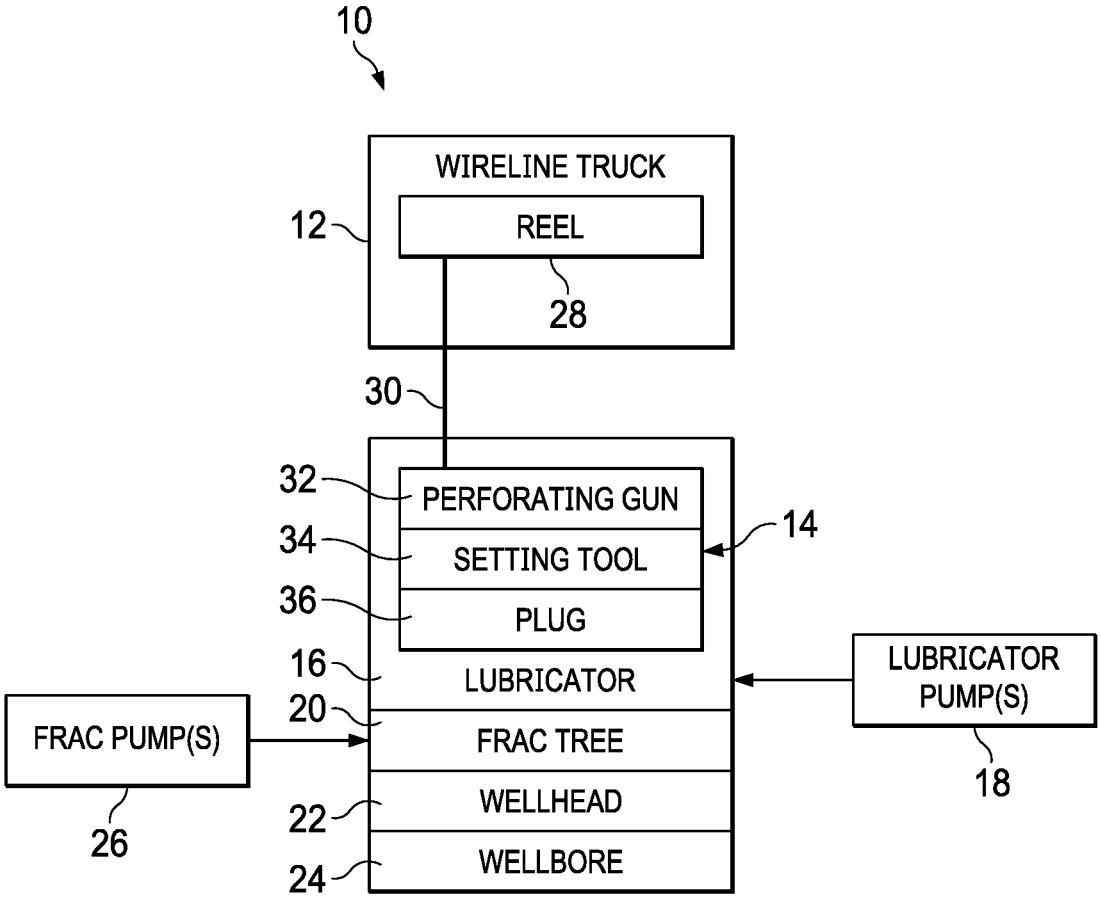
FIG. 4 is a diagrammatic illustration of the lubricator system of FIG. 1 in a first operational state in which the downhole tool extends within the lubricator, according to one or more embodiments of the present disclosure.
Figure 5A:
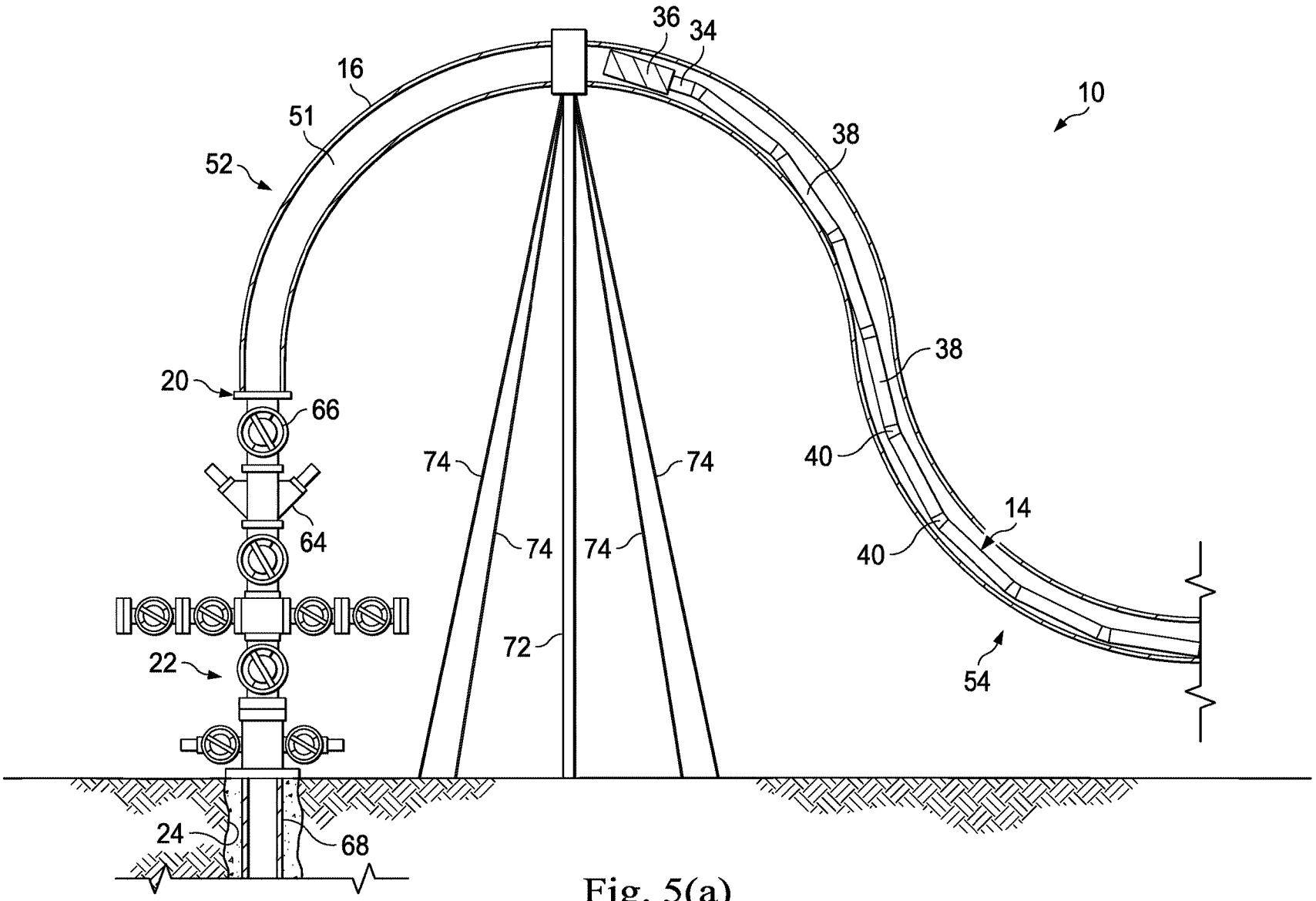
FIGS. 5(*a*) and (*b*) are elevational/schematic views in partial cross section of an embodiment of the first operational state illustrated in FIG. 4 in which FIG. 2's downhole tool extends within FIG. 3's lubricator, according to one or more embodiments of the present disclosure.
Figure 5B:
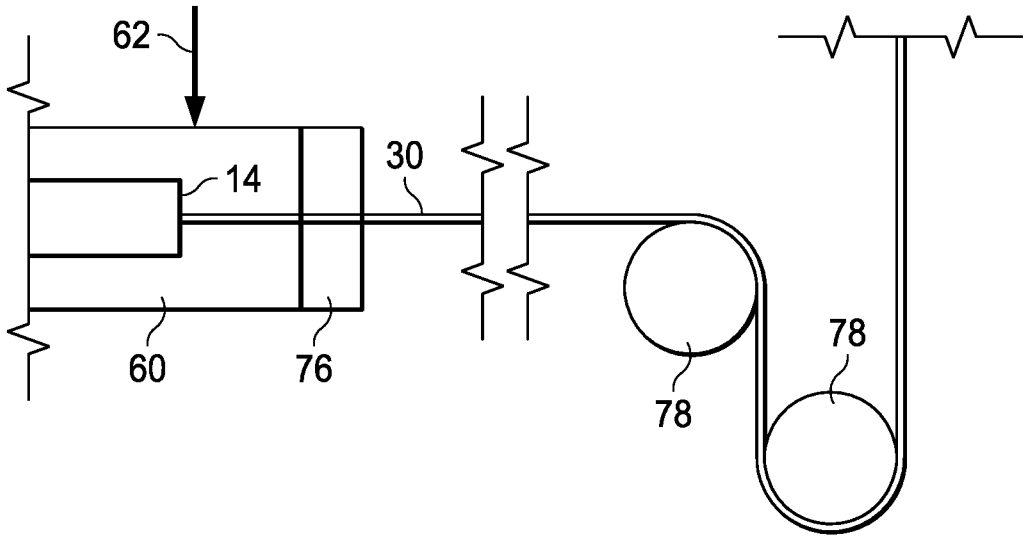
Figure 6A:
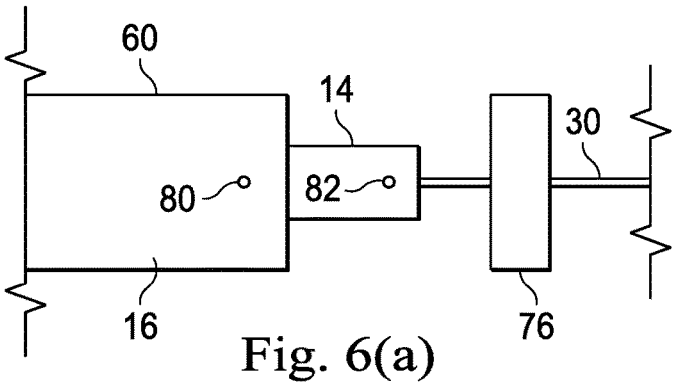
FIGS. 6(*a*)-(*d*) are schematic views of consecutive steps for loading FIG. 2's downhole tool into FIG. 4's lubricator, according to one or more embodiments of the present disclosure.
Figure 6B:
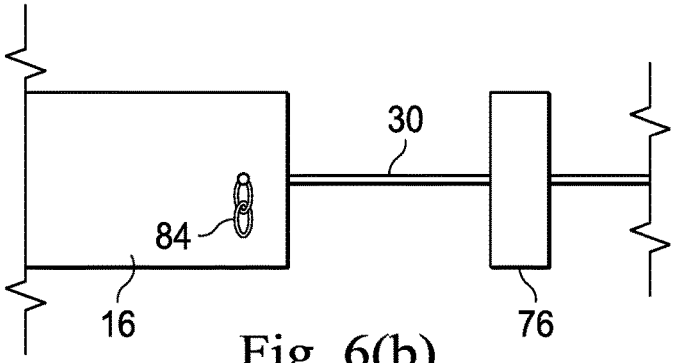
Figure 6C:
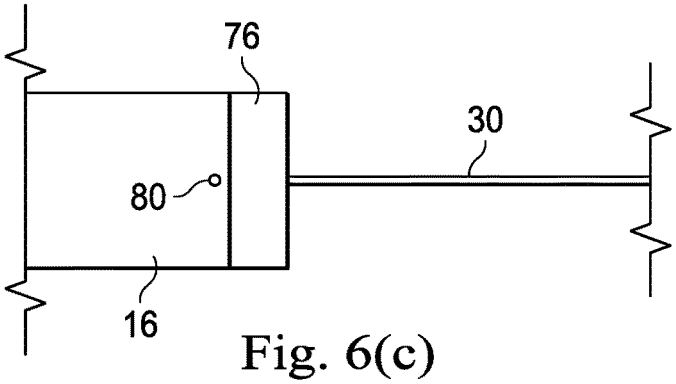
Figure 6D:
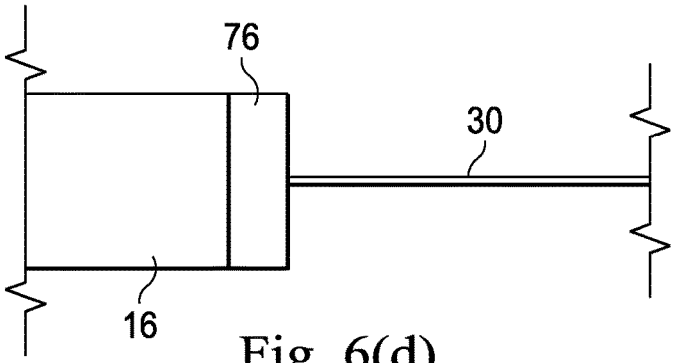

Referring to FIGS. 4, 5(*a*), and 5(*b*), the lubricator system 10 is illustrated in a first operational state in which the downhole tool 14 is positioned within the lubricator 16—the first operational state is shown diagrammatically in FIG. 4. The conveyance string 30 is connected to the downhole tool 14 and extends out of the lubricator 16 to the reel 28 on the conveyance truck 12. In the first operational state of the lubricator system 10, the lubricator pump(s) 18 are adapted to pump fluid into the lubricator 16 behind the plug 36 to thereby create a pressure differential across the plug 36. The pressure differential across the plug 36 urges the downhole tool 14 through the lubricator 16 like a piston so that, as the conveyance string 30 is unwound from the reel 28, the downhole tool 14 moves through the lubricator 16 toward the frac tree 20.

Turning to FIGS. 5(*a*) and (*b*), an embodiment of the first operational state of the lubricator system 10 is shown in which the downhole tool 14 extends within, or at least immediately upstream of, the downwardly concave section 52, and further extends within the upwardly concave section 54 and the end portion 60 of the lubricator 16. To enable the extension of the downhole tool 14 within the upwardly concave section 54 and the downwardly concave section 52 of the lubricator 16, the downhole tool 14 pivots about the axes 44 and 46 (shown in FIG. 2) via the pivot joints 40—such pivoting generally aligns the downhole tool 14 with the curvilinear axes 56 and 58 (shown in FIG. 3) of the lubricator 16. The end portion 60 of the lubricator 16 is sealingly engaged (e.g., threadably) by a sealing cap 76 through which the conveyance string 30 extends. The conveyance string 30 is guided via pulleys 78 to the reel 28 on the conveyance truck 12 (shown in FIG. 4). The sealing cap 76 sealingly engages the conveyance string 30 to prevent, or at least reduce, leakage of fluid from inside the lubricator 16 to atmosphere.

The lubricator pump(s) 18 are connected to the lubricator 16 and adapted to pump fluid into the lubricator 16 behind the plug 36 to thereby create the pressure differential across the plug 36, as indicated by the arrow 62 (also shown in FIG. 3). The radial clearance between the plug 36 and the lubricator 16 is less than the radial clearance between the setting tool 34 and the lubricator 16, and is less than the radial clearance between the perforating gun 32 and the lubricator 16—this reduced clearance enables the pressure differential to be created across the plug 36. Additionally, the sealing engagement of the sealing cap 76 with both the conveyance string 30 and the end portion 60 of the lubricator 16 holds backpressure caused by the pumping of the fluid into the lubricator 16 by the lubricator pump(s) 18, thereby enabling the pressure differential to be created across the plug 36. The pressure differential across the plug 36 urges the downhole tool 14 through the lubricator 16 like a piston so that, as the conveyance string 30 is unwound from the reel 28, the downhole tool 14 moves through the lubricator 16 toward the frac tree 20.

Turning to FIGS. 6(*a*)-(*d*) with continuing reference to FIGS. 5(*a*) and (*b*), the manner in which the downhole tool 14 is loaded into the lubricator 16 is illustrated. As shown in FIG. 6(*a*), before the sealing cap 76 is sealingly engaged with the end portion 60 of the lubricator 16, the downhole tool 14 is inserted into the lubricator 16 via the end portion 60 thereof. The conveyance string 30 extends through the sealing cap 76 and is connected to the downhole tool 14. The end portion 60 of the lubricator 16 includes a pin-hole 80. The downhole tool 14 includes a pin-hole 82 adapted to be aligned with the pin-hole 80 of the lubricator 16. As shown in FIG. 6(*b*), after the downhole tool 14 is inserted into the lubricator 16 via the end portion 60 thereof, the respective pin-holes 80 and 82 of the downhole tool 14 and the lubricator 16 are aligned—once so aligned, a pin 84 is inserted into the pin-holes 80 and 82. The pin 84 retains the downhole tool 14 within the lubricator 16 so that the sealing cap 76 may be connected to the end portion 60 of the lubricator 16 (i.e., the pin 84 prevents gravity from ejecting the downhole tool 14, due to the curved shape of the lubricator 16, before the sealing cap 76 is connected). As shown in FIG. 6(*c*), after the pin 84 is inserted into the pin-holes 80 and 82 to retain the downhole tool 14 within the lubricator 16, the sealing cap 76 is partially connected to the end portion 60 of the lubricator 16. This partial connection of the sealing cap 76 to the end portion 60 of the lubricator 16 holds the downhole tool 14 within the lubricator 16 regardless of whether or not the pin 84 in inserted into the pin-holes 80 and 82, thereby enabling removal of the pin 84 from the pin-holes 80 and 82. As shown in FIG. 6(*d*), after the pin 84 is removed from the pin-holes 80 and 82, the sealing cap 76 is fully connected to the end portion 60 of the lubricator 16—once so fully connected, the sealing cap 76 covers the pin-hole 80 and sealingly engages the conveyance string 30 to prevent, or at least reduce, leakage of fluid (e.g., fluid pumped from the lubricator pump(s) 18) from inside the lubricator 16 to atmosphere.

Figure 7:
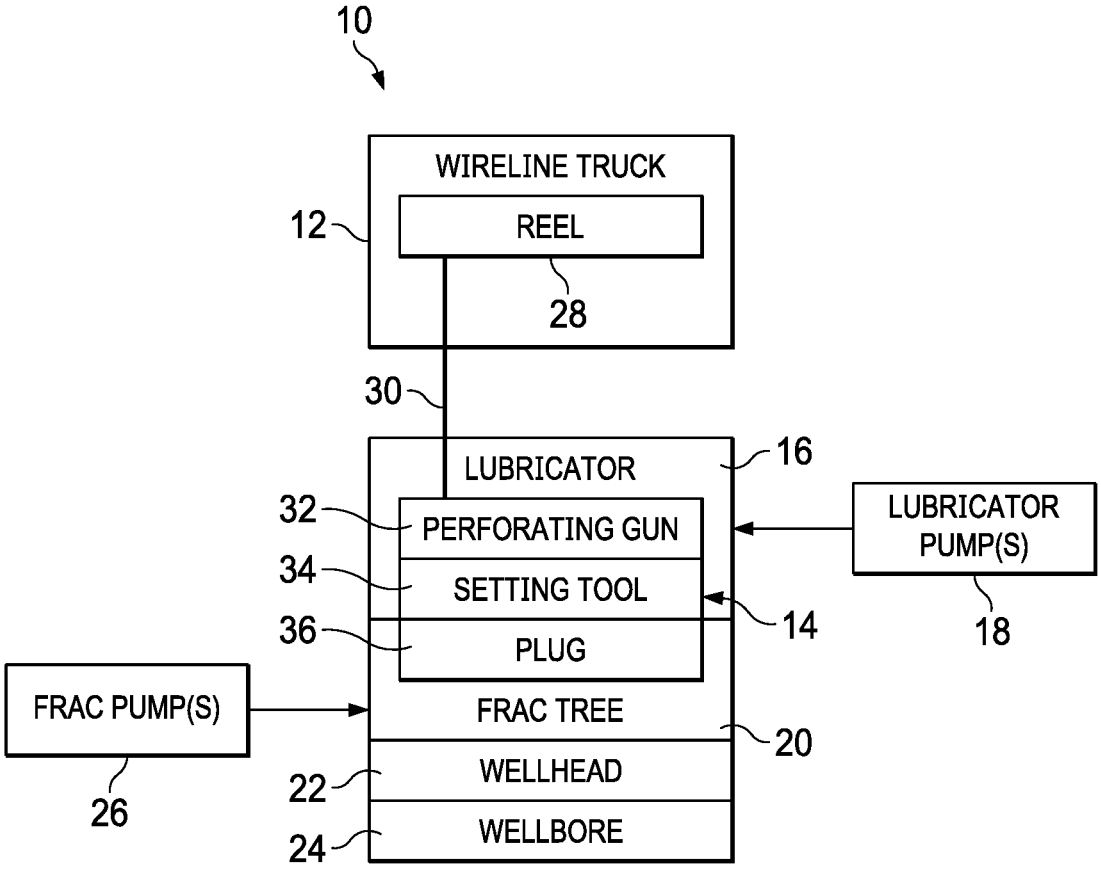
FIG. 7 is a diagrammatic illustration of the lubricator system of FIG. 1 in a second operational state in which the downhole tool extends within the lubricator and the fracturing tree, according to one or more embodiments of the present disclosure.
Figure 8:
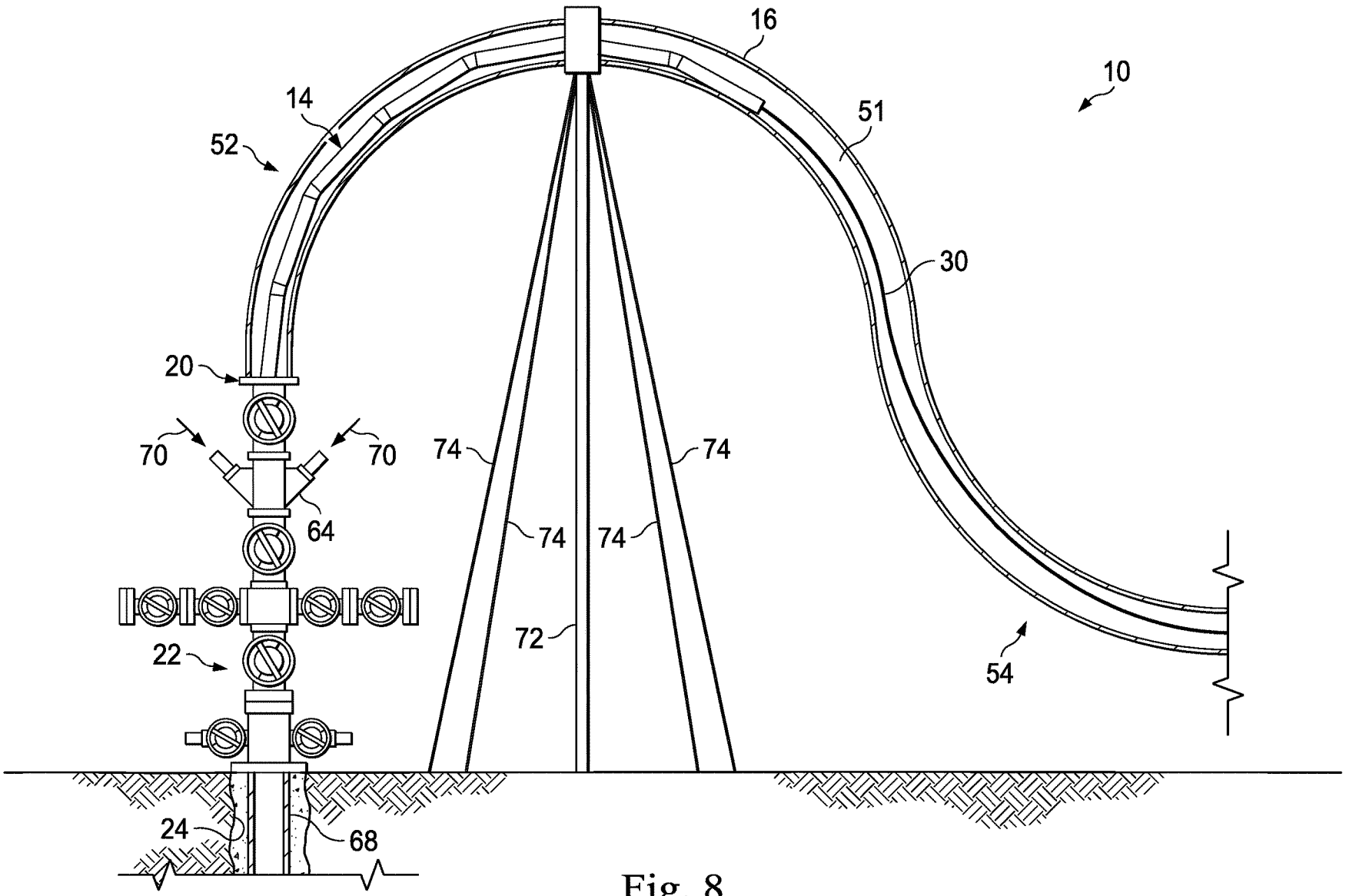
FIG. 8 is an elevational/schematic view in partial cross section of an embodiment of the second operational state illustrated in FIG. 7, according to one or more embodiments of the present disclosure.

Referring to FIGS. 7 and 8, the lubricator system 10 is illustrated in a second operational state in which part of the downhole tool 14 extends within the frac tree 20—the second operational state of the lubricator system 10 is shown diagrammatically in FIG. 7. To actuate the lubricator system 10 from the first operational state to the second operational state, the lubricator pump(s) 18 pump fluid into the lubricator 16 behind the plug 36, causing the downhole tool 14 to move through the lubricator 16 toward the frac tree 20, as described above. In the second operational state of the lubricator system 10, the frac pump(s) 26 are adapted to pump fluid into the frac tree 20 behind the plug 36 to thereby create a pressure differential across the plug 36. When the frac pump(s) 26 pump fluid into the frac tree 20, the lubricator pump(s) 18 may or may not continue to pump fluid into the lubricator 16 to thereby contribute to the pressure differential across the plug 36. The pressure differential across the plug 36 urges the downhole tool 14 through the frac tree 20 and the wellhead 22 like a piston so that, as the conveyance string 30 is unwound from the reel 28, the downhole tool 14 moves through the frac tree 20 and the wellhead 22 toward the wellbore 24.

Turning to FIG. 8, an embodiment of the second operational state of the lubricator system 10 is shown in which the frac pump(s) 26 are connected to the goat head 64 and adapted to pump fluid into the frac tree 20 behind the plug 36 to thereby create the pressure differential across the plug 36, as indicated by the arrows 70 (also shown in FIG. 3). When the frac pump(s) 26 pump fluid into the frac tree 20, the lubricator pump(s) 18 may or may not continue to pump fluid into the lubricator 16 (as indicated by the arrow 62 in FIG. 5(*b*)) to thereby contribute to the pressure differential across the plug 36. The radial clearance between the plug 36 and the respective interiors of the frac tree 20 and the wellhead 22 is less than the radial clearance between the setting tool 34 and the lubricator 16, and is less than the radial clearance between the perforating gun 32 and the lubricator 16—this reduced clearance enables the pressure differential to be created across the plug 36. Additionally, the sealing engagement of the sealing cap 76 with both the conveyance string 30 and the end portion 60 of the lubricator 16 holds backpressure caused by the pumping of the fluid into the frac tree 20 by the frac pump(s) 26 (and, optionally, by the pumping of the fluid into the lubricator 16 by the lubricator pump(s) 18), thereby enabling the pressure differential to be created across the plug 36. The pressure differential across the plug 36 urges the downhole tool 14 through the frac tree 20 and the wellhead 22 like a piston so that, as the conveyance string 30 is unwound from the reel 28, the downhole tool 14 moves through the frac tree 20 and the wellhead 22 toward the wellbore 24.

Figure 9:
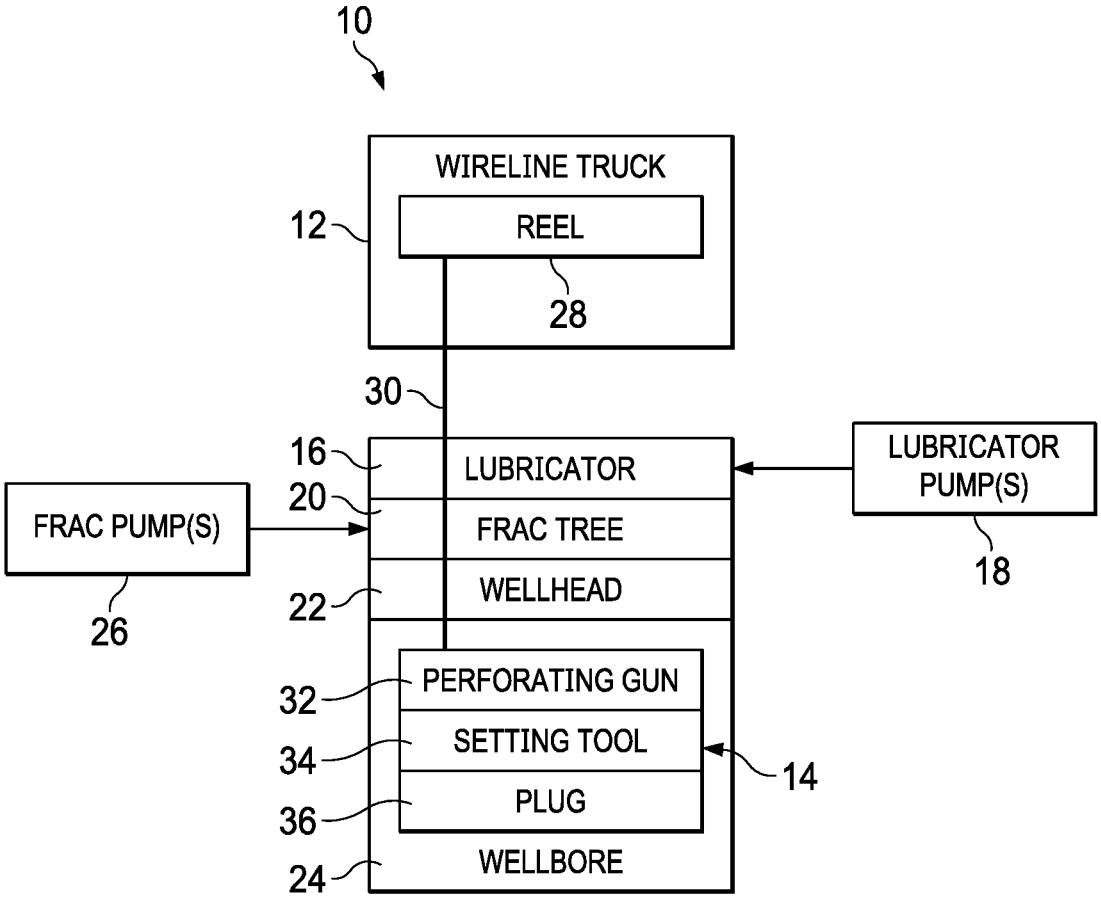
FIG. 9 is a diagrammatic illustration of the lubricator system of FIG. 1 in a third operational state in which the downhole tool extends within the wellbore, according to one or more embodiments of the present disclosure.
Figure 10A:
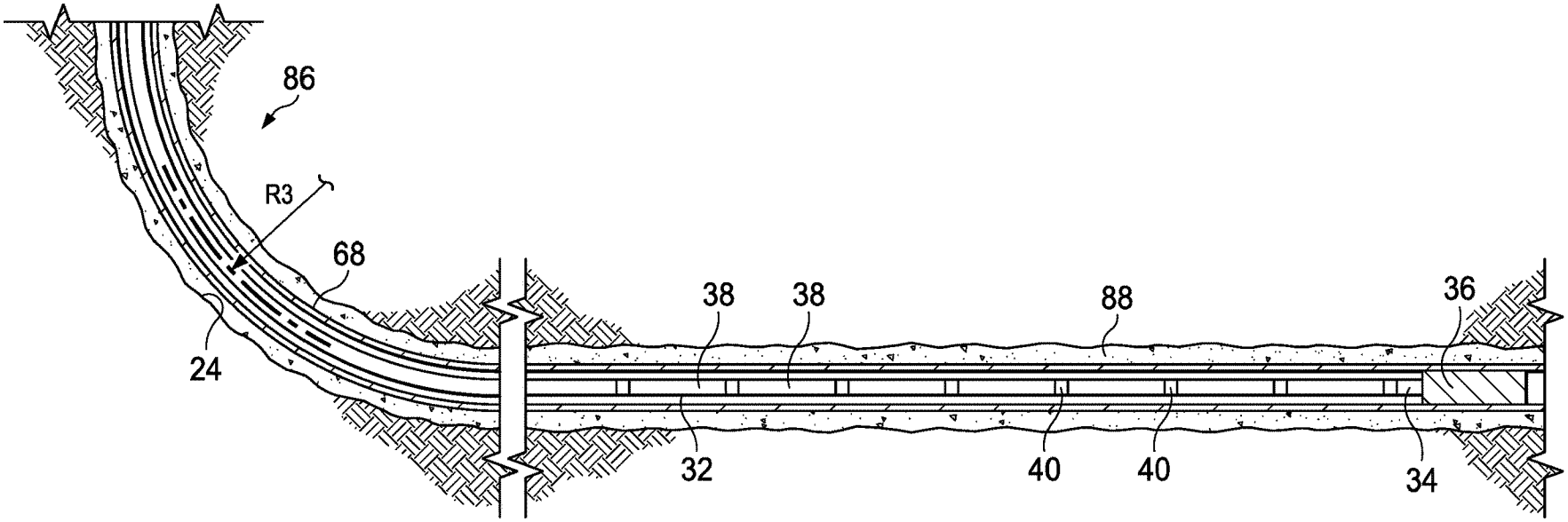
FIGS. 10(*a*)-(*c*) are elevational/schematic views in partial cross section of an embodiment of the third operational state illustrated in FIG. 9, according to one or more embodiments of the present disclosure.
Figure 10B:
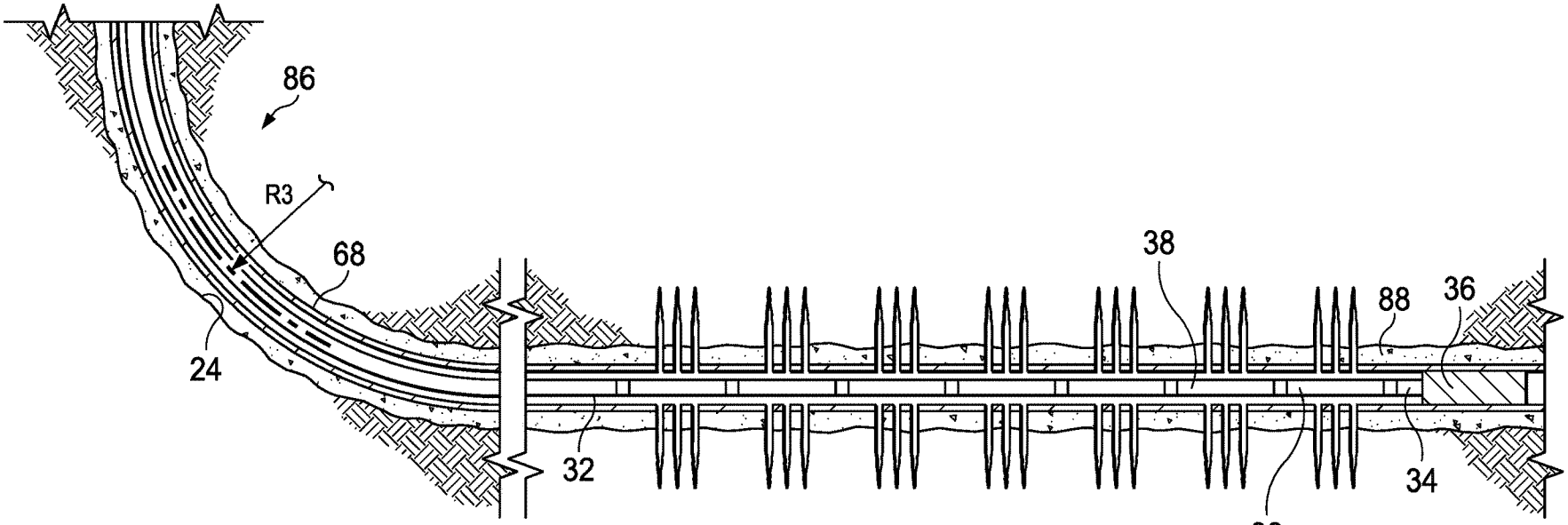
Figure 10C:
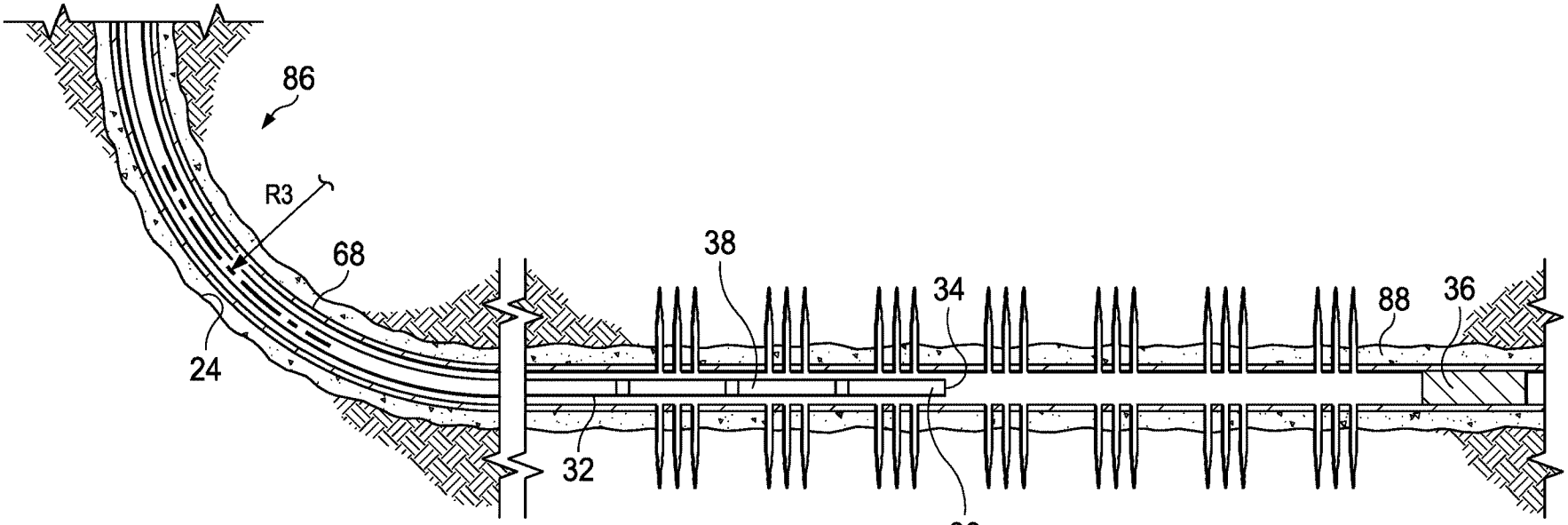

Referring to FIGS. 9 and 10(*a*)-(*c*), the lubricator system 10 is illustrated in a third operational state in which the downhole tool 14 is positioned within the wellbore 24—the third operational state of the lubricator system 10 is shown diagrammatically in FIG. 9. The conveyance string 30 extends from the reel 28 on the conveyance truck 12, through the lubricator 16, the frac tree 20, the wellhead 22, and the wellbore 24, and to the downhole tool 14. To actuate the lubricator system 10 from the second operational state to the third operational state, the frac pump(s) 26 pump fluid into the frac tree 20 behind the plug 36, causing the downhole tool 14 to move through the frac tree 20 and the wellhead 22 toward the wellbore 24, as described above. Moreover, as described above, the lubricator pump(s) 18 may or may not continue to pump fluid into the lubricator 16 to thereby contribute to the actuation of the lubricator system 10 from the second operational state to the third operational state. In the third operational state of the lubricator system 10, the downhole tool 14 is adapted to perform the "plug-and-perf" operation, as will be described in further detail below.

Turning to FIGS. 10(*a*)-(*c*), an embodiment of the third operational state of the lubricator system 10 is shown in which the wellbore 24 includes a curved section 86 and a horizontal or inclined section 88. The curved section 86 defines a radius R3. The radius R3 is substantially equal to, or greater than, the radii R1 and R2 of the lubricator 16. In some embodiments, the radius R3 of the wellbore 24 may be significantly less than that of conventional wellbores due to the pivotability of the downhole tool 14, thus facilitating greater exploitation of a given subterranean zone. To enable the lowering of the downhole tool 14 through the curved section 86 and into the horizontal or inclined section 88, the downhole tool 14 pivots about the axes 44 and 46 (shown in FIG. 2) via the pivot joints 40. The lowering of the downhole tool 14 into the wellbore 24 is made possible by gravity and the continued pumping of fluid into the frac tree 20 by the frac pump(s) 26. FIG. 10(*a*) shows the setting tool 34 setting the plug 36 in the horizontal or inclined section 88 of the wellbore 24 as part of the "plug-and-perf" operation. FIG. 10(*b*) shows the perforating gun 32 perforating the wellbore 24 by exploding the explosive charges in the perforator segments 38 as part of the "plug-and-perf" operation. Finally, FIG. 10(*c*) shows the perforating gun 32 and the setting tool 34 being retrieved from the wellbore 24. In some embodiments, the perforating gun 32 and the setting tool 34 are retrieved from the wellbore 24 by winding the conveyance string 30 onto the reel 28 of the conveyance truck 12. The plug 36 remains in the wellbore 24 to enable the execution of a fracturing operation on the perforated section of the wellbore 24.

Figure 11:
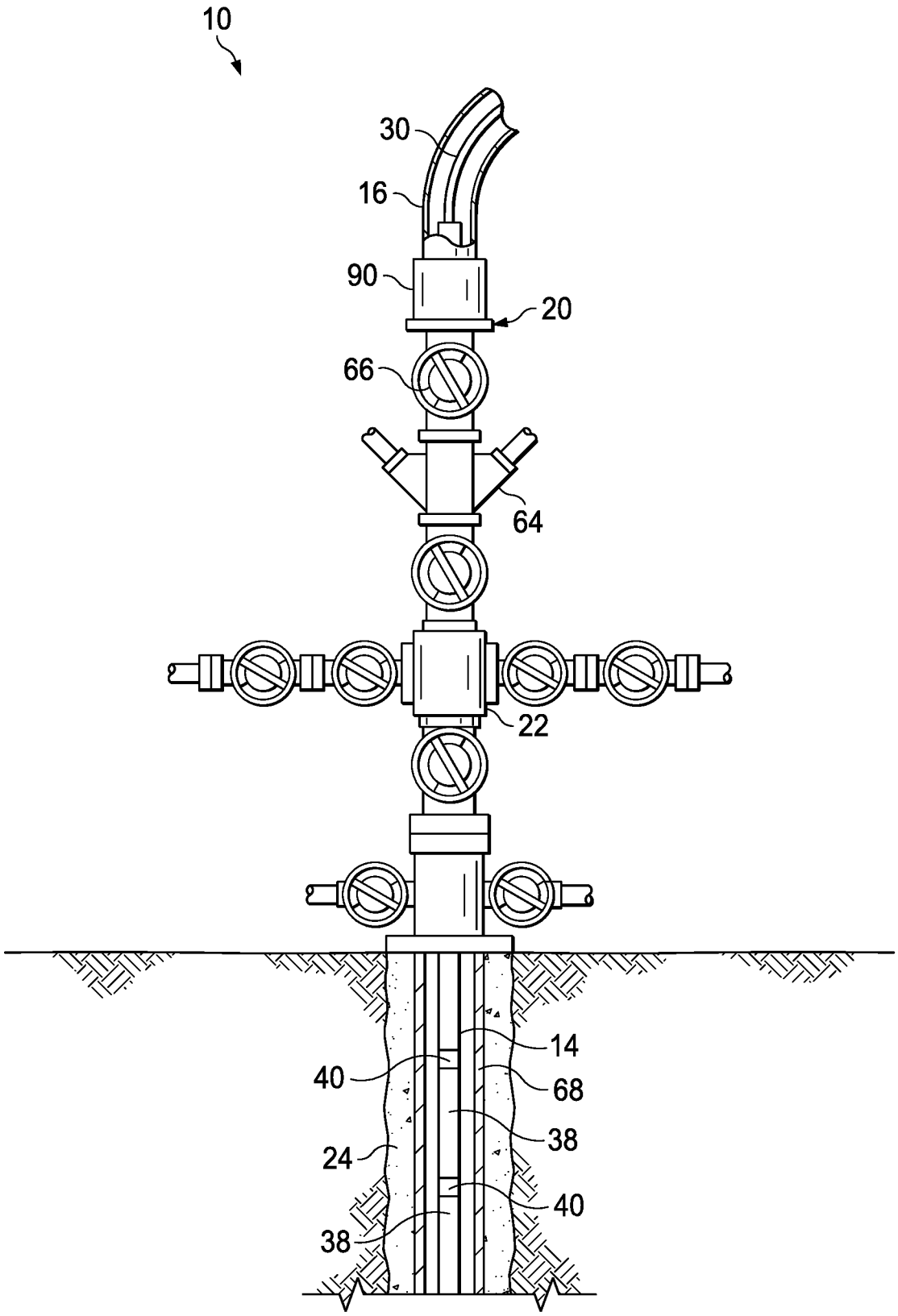
FIG. 11 is an elevational/schematic view in partial cross section of an embodiment of a portion of the lubricator system of FIG. 1, the wellhead including an orienting device, according to one or more embodiments of the present disclosure.
Figure 12A:
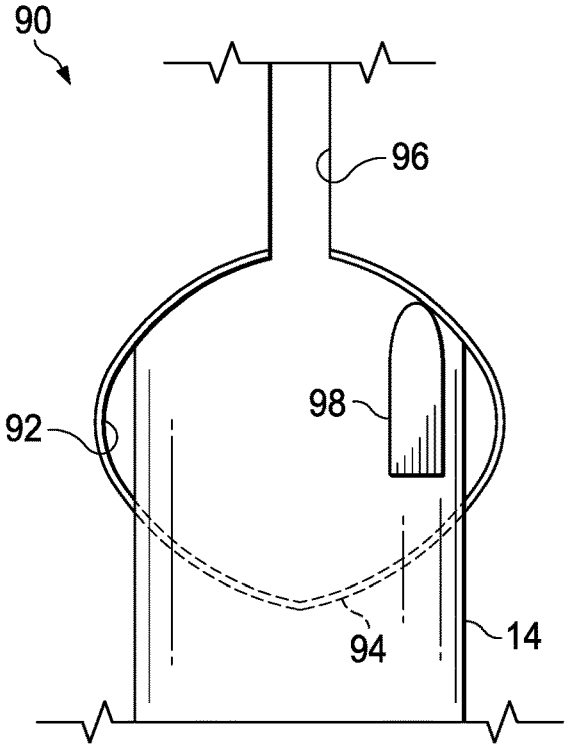
FIGS. 12(*a*) and (*b*) are schematic views of the orienting device of FIG. 11, according to one or more embodiments of the present disclosure.
Figure 12B:
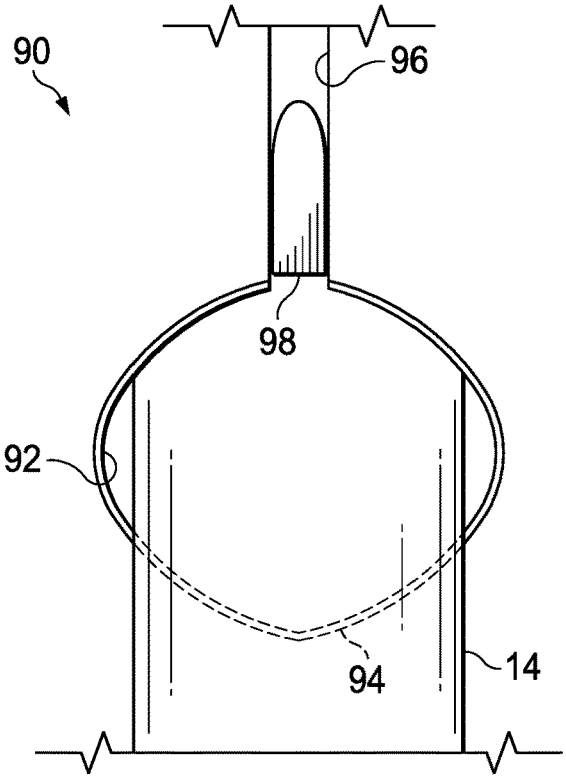

Referring to FIGS. 11, 12(*a*), and 12(*b*), in some embodiments, the lubricator system 10 includes an orienting device 90 adapted to ensure proper orientation of the downhole tool 14 relative to the lubricator 16 upon the re-entry of the downhole tool 14 into the lubricator 16 from the wellbore 24. The orienting device 90 is connected to the frac tree 20 opposite the wellhead 22, as shown in FIG. 11. However, rather than being connected to the frac tree 20 opposite the wellhead 22, in some embodiments, the orienting device 90 may be connected between the frac tree 20 and the wellhead 22, between the wellhead 22 and the casing string 68, or elsewhere in the lubricator system 10. As the downhole tool 14 passes through the orienting device 90 in an upward direction, the orienting device 90 is adapted to rotate the downhole tool 14 so that pivoting of the pivot joints 40 about the axes 44 and 46 (shown in FIG. 2) is permitted when the downhole tool 14 re-enters the lubricator 16.

Turning to FIGS. 12(*a*) and (*b*), the manner in which the orienting device 90 rotates the downhole tool 14 into the proper orientation is illustrated. The orienting device 90 includes an internal passage 92, a profile surface 94, and a longitudinally-extending slot 96—for clarity, other parts of the orienting device 90 are omitted from view in FIGS. 12(*a*) and (*b*). The internal passage 92 of the orienting device 90 receives the downhole tool 14 from the wellbore 24. The profile surface 94 of the orienting device 90 extends about the internal passage 92 and slopes toward the longitudinally-extending slot 96. The downhole tool 14 includes an orienting key 98 adapted engage the profile surface 94 of the orienting device 90 as the downhole tool 14 passes through the orienting device 90 in the upward direction. The engagement of the orienting key 98 with the profile surface 94 as the downhole tool 14 moves in the upward direction causes the downhole tool 14 to rotate until the orienting key 98 is received within the longitudinally-extending slot 96. The longitudinally-extending slot 96 is positioned to ensure proper orientation of the downhole tool 14 as the downhole tool 14 enters the lubricator 16. In some embodiments, the downhole tool 14 includes one or more longitudinally-spaced orienting keys each of which is substantially identical to the orienting key 98.

Figure 13:
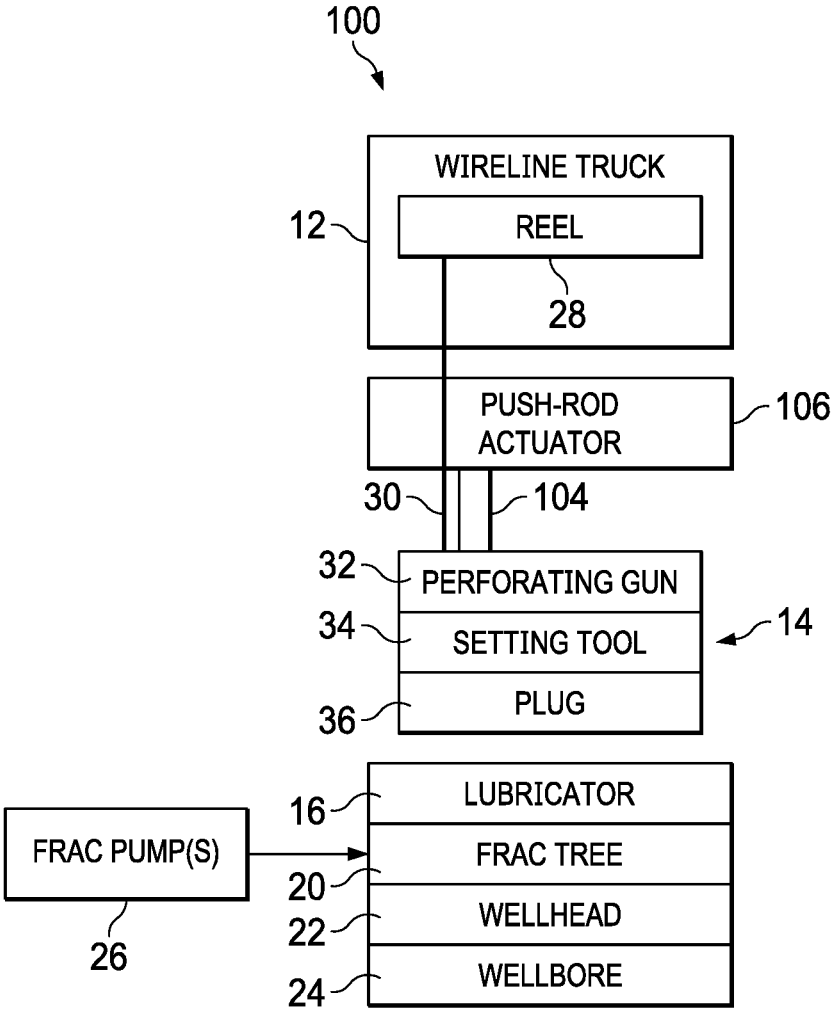
FIG. 13 is a diagrammatic illustration of a lubricator system including a lubricator, a downhole tool, a pushrod actuator, and a pushrod, the lubricator system being connected to a fracturing tree, which is connected to a wellhead located at the top or head of an oil and gas wellbore, according to one or more embodiments of the present disclosure.
Figure 14:
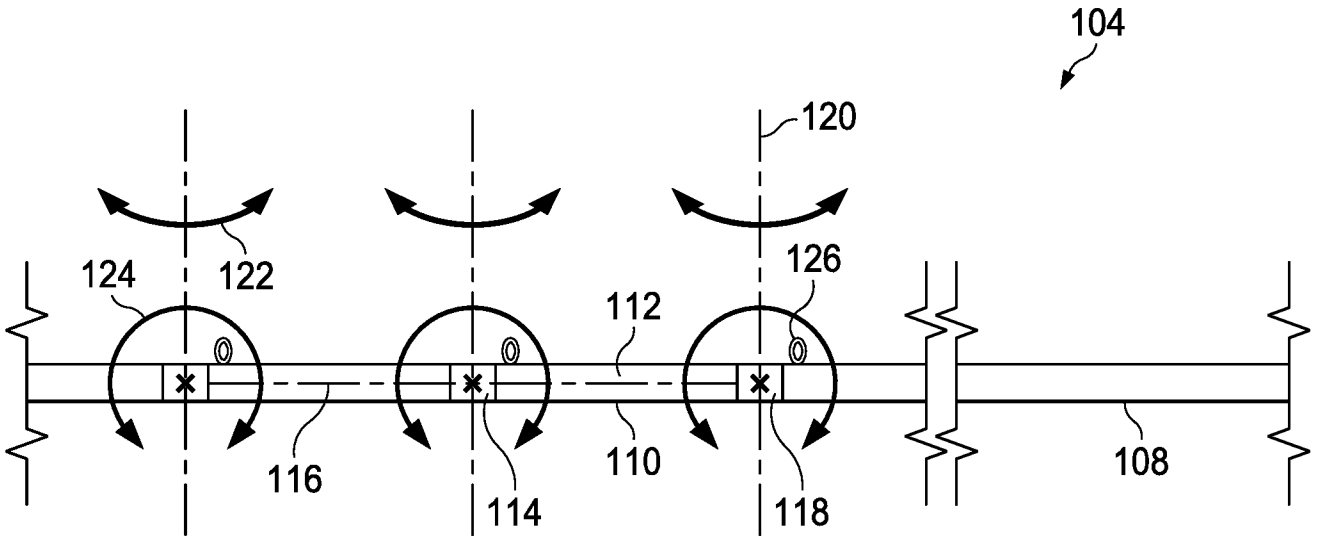
FIG. 14 is a schematic view of an embodiment of the pushrod of FIG. 13, the pushrod including a solid portion and a segmented portion, according to one or more embodiments of the present disclosure.

Referring to FIGS. 13 and 14, a lubricator system is generally referred to by the reference numeral 100—the lubricator system 100 is substantially identical to the lubricator system 10, except that, instead of the lubricator 16 and the lubricator pump(s) 18, the lubricator system 100 includes a lubricator 102, a pushrod 104, and a pushrod actuator 106. Therefore, in connection with FIGS. 13-15, 16(*a*), 16(*b*), and 17-19, parts of the lubricator system 100 that are substantially identical to corresponding parts of the lubricator system 10 are given the same reference numerals. Thus, the lubricator system 100 includes the conveyance truck 12, the downhole tool 14, the lubricator 102, the pushrod 104, and the pushrod actuator 106—the lubricator system 100 is shown diagrammatically in FIG. 13. The lubricator 102 is connected to the frac tree 20. The frac tree 20 is connected to the wellhead 22 opposite the lubricator 102. The frac pump(s) 26 are connected to, and adapted to be in fluid communication with, the frac tree 20. The conveyance truck 12 includes the reel 28 on which the conveyance string 30 is coiled. The conveyance string 30 is connected to the downhole tool 14 opposite the reel 28. The pushrod actuator 106 is connected to the pushrod 104, which pushrod, in turn, is adapted to engage the downhole tool 14.

Turning to FIG. 14, an embodiment of the pushrod 104 is shown including a solid portion 108 and a segmented portion 110. The segmented portion 110 includes pusher segments 112 and pivot joints 114 extending along a longitudinal axis 116. Most of the pivot joints 114 are interposed between respective ones of the pushrod 104's pusher segments 112—but at least one of the pivot joints 114 is interposed between the segmented portion 110 and the solid portion 108 of the pushrod 104. The pivot joints 114 permit pivoting of the pusher segments 112 relative to one another, and pivoting of the segmented portion 110 relative to the solid portion 108 of the pushrod 104. More particularly, the pivot joints 114 each permit pivoting about a pair of axes 118 and 120, as indicated by curvilinear arrows 122 and 124, respectively. The axes 118 and 120 are spaced in a substantially perpendicular relation with one another. Moreover, the longitudinal axis 116 is spaced in a substantially perpendicular relation with the axes 118 and 120. The pushrod 104 includes eyelets 126 connected to the segmented portion 110 of the pushrod 104 and spaced therealong to accommodate the conveyance string 30, as will be described in further detail below. In addition to, or instead of, permitting pivoting about the axes 118 and 120, the pivot joints 114 may be adapted to permit pivoting about one or more additional axes perpendicular to the longitudinal axis 116, and/or about the longitudinal axis 116 itself. Moreover, although described herein as including pivot joints, other pushrods are contemplated that include flexible portions instead (or in addition) to enable similar pivotability.

Figure 15:
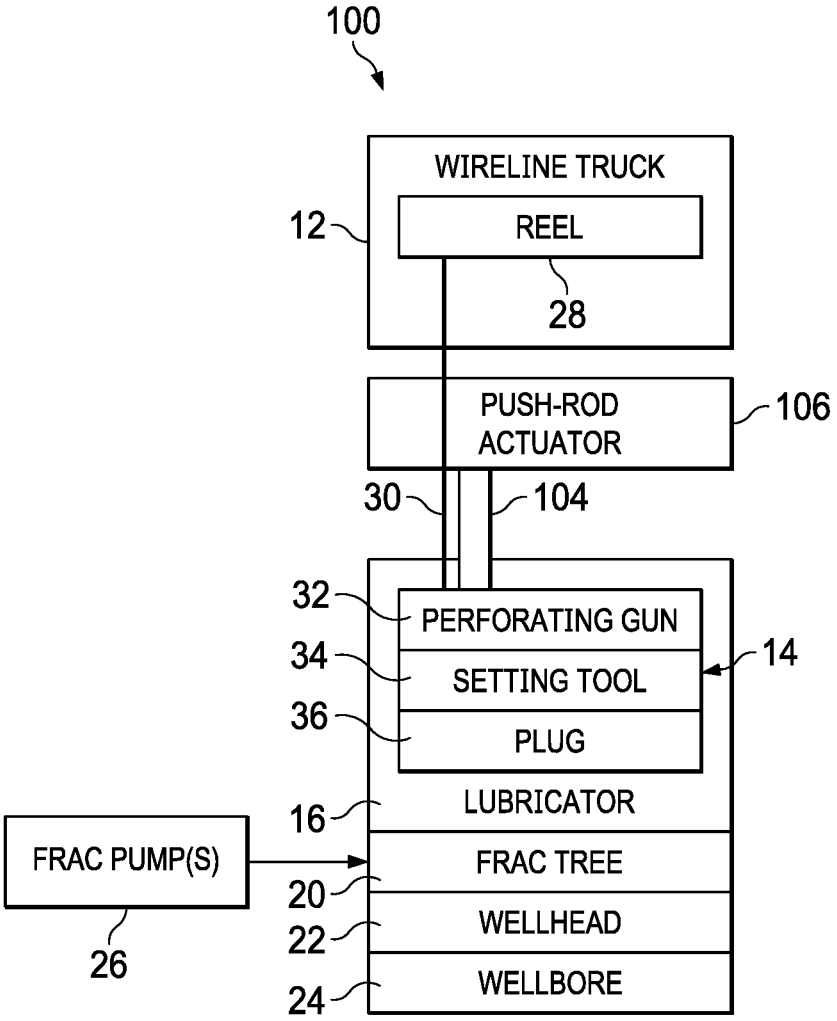
FIG. 15 is a diagrammatic illustration of the lubricator system of FIG. 13 in a first operational state in which the downhole tool extends within the lubricator, according to one or more embodiments of the present disclosure.
Figure 16A:
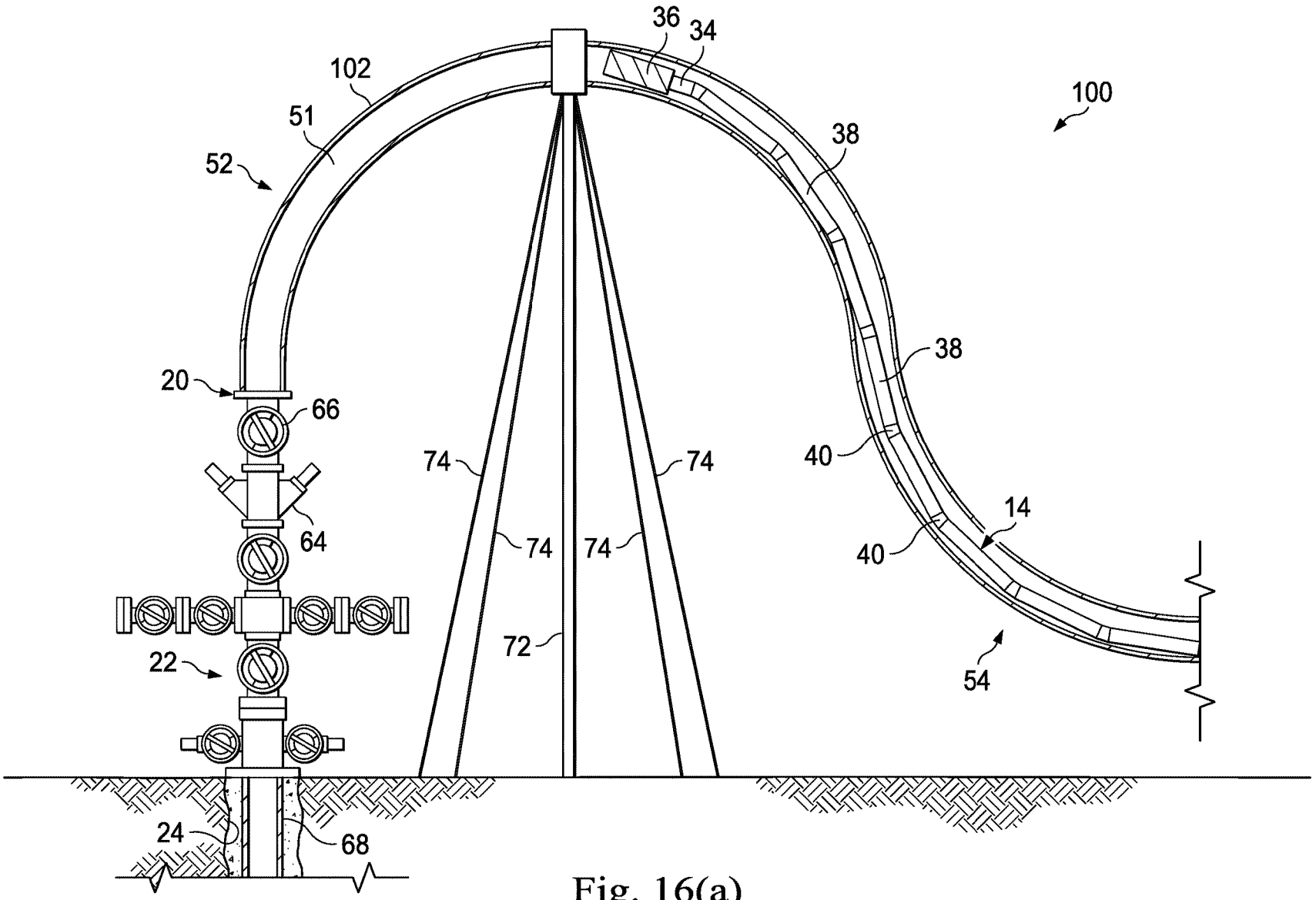
FIGS. 16(*a*) and (*b*) are elevational/schematic views in partial cross section of an embodiment of the first operational state illustrated in FIG. 15, according to one or more embodiments of the present disclosure.
Figure 16B:
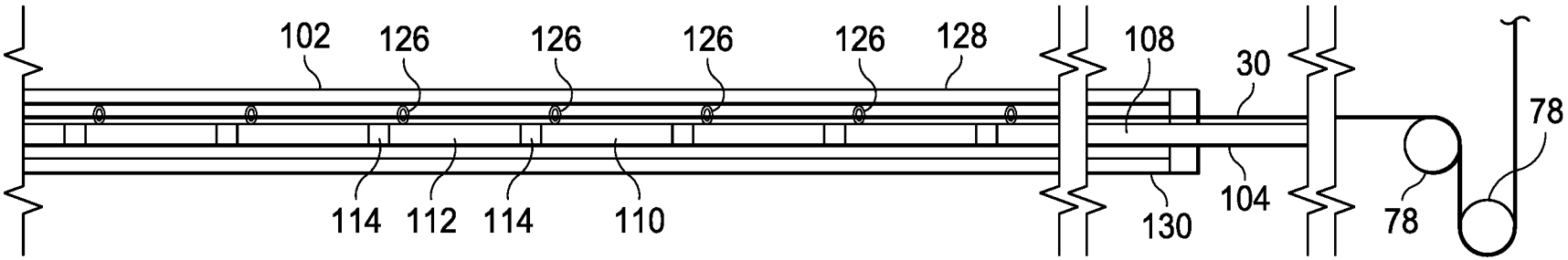

Referring to FIGS. 15, 16(*a*), and 16(*b*), the lubricator system 100 is illustrated in a first operational state in which the downhole tool 14 and part of the pushrod 104 are positioned within the lubricator 102—the first operational state of the lubricator system 100 is shown diagrammatically in FIG. 15. The conveyance string 30 is connected to the downhole tool 14 and extends out of the lubricator 102 to the reel 28 on the conveyance truck 12. The pushrod 104 engages the downhole tool 14 and extends out of the lubricator 102 to the pushrod actuator 106. In the first operational state of the lubricator system 100, the pushrod actuator 106 is adapted to actuate the pushrod 104 in a manner that causes the pushrod 104 to engage the downhole tool 14 so that the downhole tool 14 moves through the lubricator 102 toward the frac tree 20.

Turning to FIGS. 16(*a*) and (*b*), an embodiment of the first operational state of the lubricator system 100 is shown in which the lubricator 102 is substantially identical to the lubricator 16, except that, instead of the end portion 60, the lubricator 102 includes an end portion 128 adapted to accommodate the pushrod 104. Therefore, in connection with FIGS. 16(*a*), 16(*b*), and 18, parts of the lubricator 102 that are substantially identical to corresponding parts of the lubricator 16 are given the same reference numerals. As a result, in the first operational state of the lubricator system 100, the downhole tool 14 extends within the downwardly concave section 52, the upwardly concave section 54, and the end portion 128 of the lubricator 102. To enable the extension of the downhole tool 14 within the upwardly concave section 54 and the downwardly concave section 52 of the lubricator 102, the downhole tool 14 pivots about the axes 44 and 46 (shown in FIG. 2) via the pivot joints 40—such pivoting generally aligns the downhole tool 14 with the curvilinear axes 56 and 58 of the lubricator 102.

The end portion 128 of the lubricator 102 is sealingly engaged (e.g., threadably) by a sealing cap 130 through which the conveyance string 30 and the pushrod 104 extend. The sealing cap 130 sealingly engages the conveyance string 30 and the pushrod 104 to prevent, or at least reduce, leakage of fluid from inside the lubricator 102 to atmosphere. The eyelets 126 spaced along the segmented portion 110 of the pushrod 104 accommodate the conveyance string 30 to prevent, or at least reduce, entanglement of the conveyance string 30 and the pushrod 104 within the lubricator 102. The pushrod actuator 106 (not shown in FIG. 16(*b*)) is adapted to actuate the solid portion 108 of the pushrod 104 through the sealing cap 130 in a manner that causes the segmented portion 110 of the pushrod 104 to engage the downhole tool 14 so that, as the conveyance string 30 is unwound from the reel 28, the downhole tool 14 moves through the lubricator 102 toward the frac tree 20. In some embodiments, the pushrod 104 is also adapted to assist in the retrieval of the downhole tool 14 from the wellbore 24 and/or the wellhead 22 upon completion of, for example, the "plug-and-perf" operation.

Figure 17:
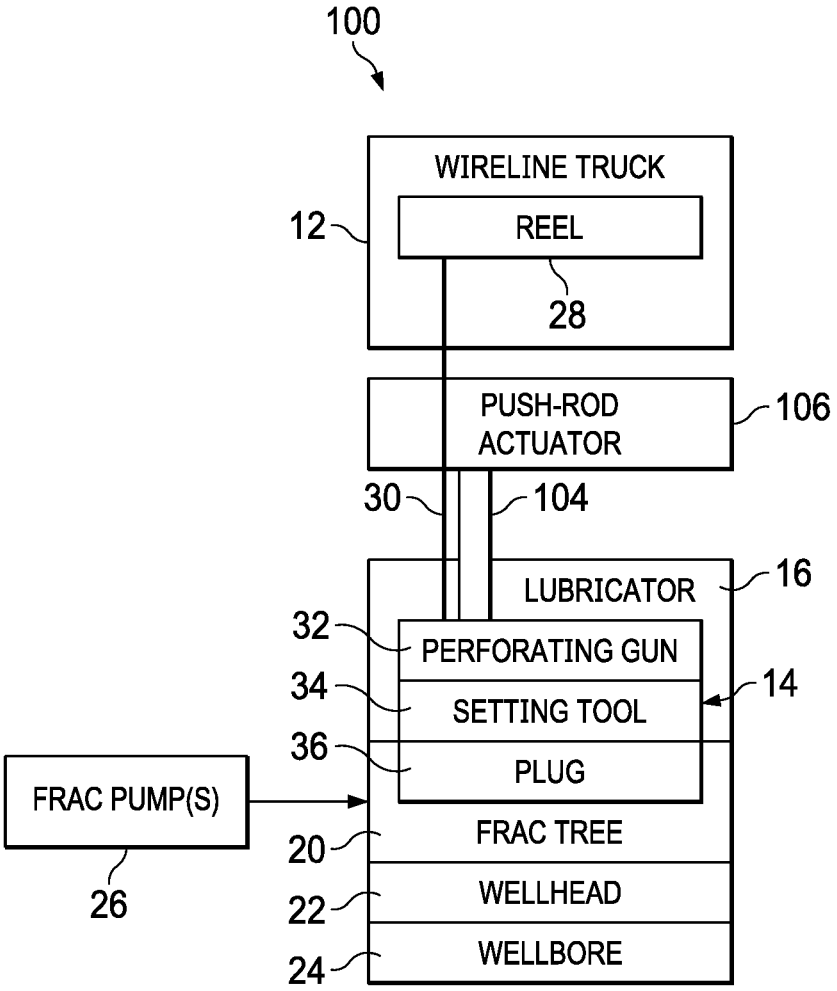
FIG. 17 is a diagrammatic illustration of the lubricator system of FIG. 13 in a second operational state in which the downhole tool extends within the lubricator and the fracturing tree, according to one or more embodiments of the present disclosure.
Figure 18:
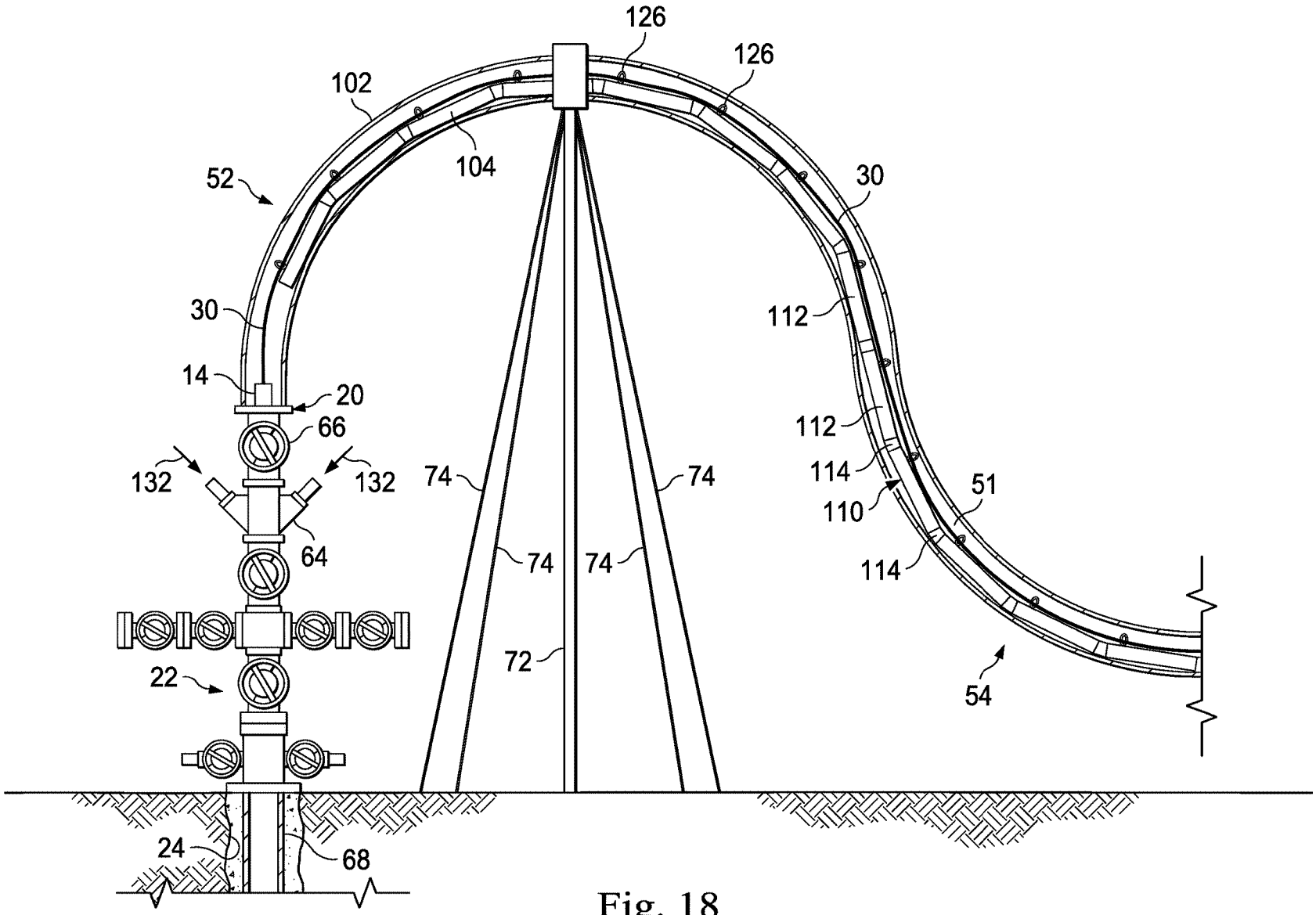
FIG. 18 is an elevational/schematic view in partial cross section of an embodiment of the second operational state illustrated in FIG. 17, according to one or more embodiments of the present disclosure.

Referring to FIGS. 17 and 18, the lubricator system 100 is illustrated in a second operational state in which part of the pushrod 104 extends within the lubricator 102 and part of the downhole tool 14 extends within the frac tree 20—the second operational state of the lubricator system 100 is illustrated diagrammatically in FIG. 17. To actuate the lubricator system 100 from the first operational state to the second operational state, the pushrod actuator 106 actuates the pushrod 104 in a manner that causes the pushrod 104 to engage the downhole tool 14 so that the downhole tool 14 moves through the lubricator 102 toward the frac tree 20, as described above. In the second operational state of the lubricator system 100, the frac pump(s) 26 are adapted to pump fluid into the frac tree 20 behind the plug 36 to thereby create a pressure differential across the plug 36. The pressure differential across the plug 36 urges the downhole tool 14 through the frac tree 20 and the wellhead 22 like a piston so that, as the conveyance string 30 is unwound from the reel 28, the downhole tool 14 disengages from the pushrod 104 and moves through the frac tree 20 and the wellhead 22 toward the wellbore 24.

Turning to FIG. 18, an embodiment of the second operational state of the lubricator system 100 is shown in which the frac pump(s) 26 are connected to the goat head 64 and adapted to pump fluid into the frac tree 20 behind the plug 36 to thereby create the pressure differential across the plug 36, as indicated by arrows 132. The radial clearance between the plug 36 and the lubricator 102 is less than the radial clearance between the setting tool 34 and the lubricator 102, and is less than the radial clearance between the perforating gun 32 and the lubricator 102—this reduced clearance enables the pressure differential to be created across the plug 36. Additionally, the sealing engagement of the sealing cap 130 with the conveyance string 30, the pushrod 104, and the end portion 128 of the lubricator 102 holds backpressure caused by the pumping of the fluid into the frac tree 20 by the frac pump(s) 26, thereby enabling the pressure differential to be created across the plug 36. The pressure differential across the plug 36 urges the downhole tool 14 through the frac tree 20 and the wellhead 22 like a piston so that, as the conveyance string 30 is unwound from the reel 28, the downhole tool disengages from the pushrod 104 and moves through the frac tree 20 and the wellhead 22 toward the wellbore 24. As the downhole tool disengages from the pushrod 104 and moves through the frac tree 20 toward the wellbore 24, the eyelets 126 spaced along the segmented portion 110 of the pushrod 104 accommodate the conveyance string 30 to prevent, or at least reduce, entanglement of the conveyance string 30 and the pushrod 104 within the lubricator 102. The accommodation of the conveyance string 30 within the eyelets 126 prevents, or at least reduces, wear or erosion that might otherwise be cause by contact between the conveyance string 30 and the interior of the lubricator 102.

Figure 19:
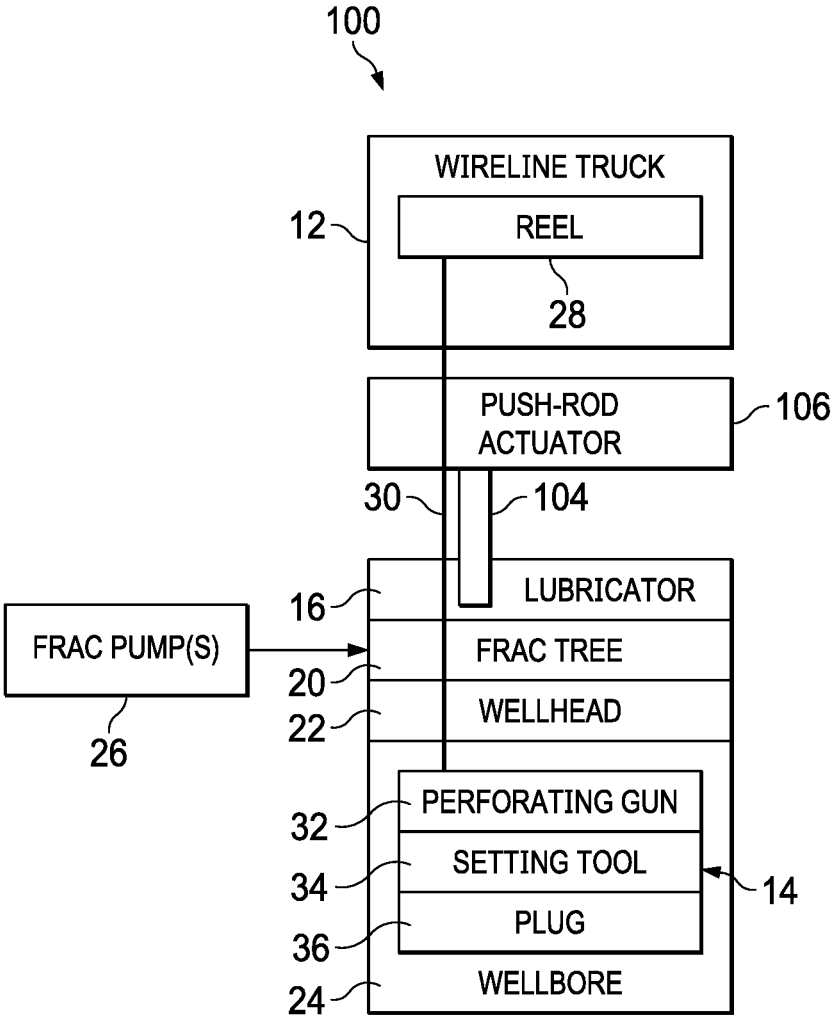
FIG. 19 is a diagrammatic illustration of the lubricator system of FIG. 13 in a third operational state in which the downhole tool extends within the wellbore, according to one or more embodiments of the present disclosure.

Referring to FIG. 19, the lubricator system 100 is illustrated in a third operational state in which part of the pushrod 104 extends within the lubricator 102 and the downhole tool 14 is positioned within the wellbore 24—the third operational state of the lubricator system 100 is shown diagrammatically in FIG. 19. The downhole tool 14 is disengaged from the pushrod 104, which pushrod, in turn, remains at least partially positioned within the lubricator 102. The conveyance string 30 extends from the reel 28 on the conveyance truck 12, through the lubricator 102, the frac tree 20, the wellhead 22, and the wellbore 24, and to the downhole tool 14. To actuate the lubricator system 100 from the second operational state to the third operational state, the frac pump(s) 26 pump fluid into the frac tree 20 behind the plug 36 so that, as the conveyance string 30 is unwound from the reel 28, the downhole tool 14 disengages from the pushrod 104 and moves through the frac tree 20 and the wellhead 22 toward the wellbore 24, as described above. Many aspects of the third operational state of the lubricator system 100 are substantially identical to the third operational state of the lubricator system 10—at least some of these substantially identical aspects can be seen by referring again to FIGS. 10(*a*)-(*c*). Therefore, the third operational state of the lubricator system 100 will not be described in further detail. Moreover, in some embodiments, the lubricator system 100 includes the orienting device 90 adapted to ensure proper orientation of the downhole tool 14 relative to the lubricator 102 upon re-entry of the downhole tool 14 into the lubricator 102 from the wellbore 24. The orienting device 90 is described above in connection with FIGS. 11, 12(*a*), and 12(*b*), and, therefore, will not be described in further detail.

Figure 20:
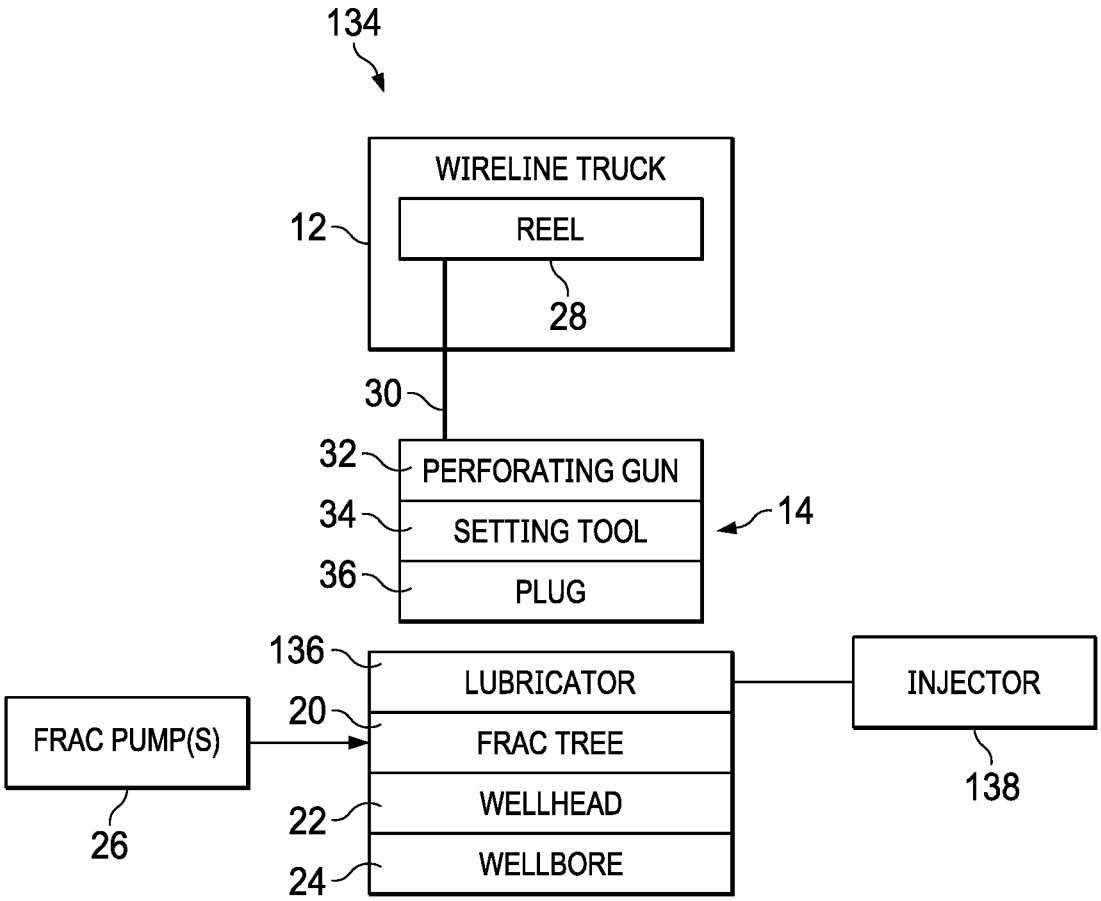
FIG. 20 is a diagrammatic illustration of a lubricator system including a lubricator, a downhole tool, and an injector, the lubricator system being connected to a fracturing tree, which is connected to a wellhead located at the top or head of an oil and gas wellbore, according to one or more embodiments of the present disclosure.
Figure 21:
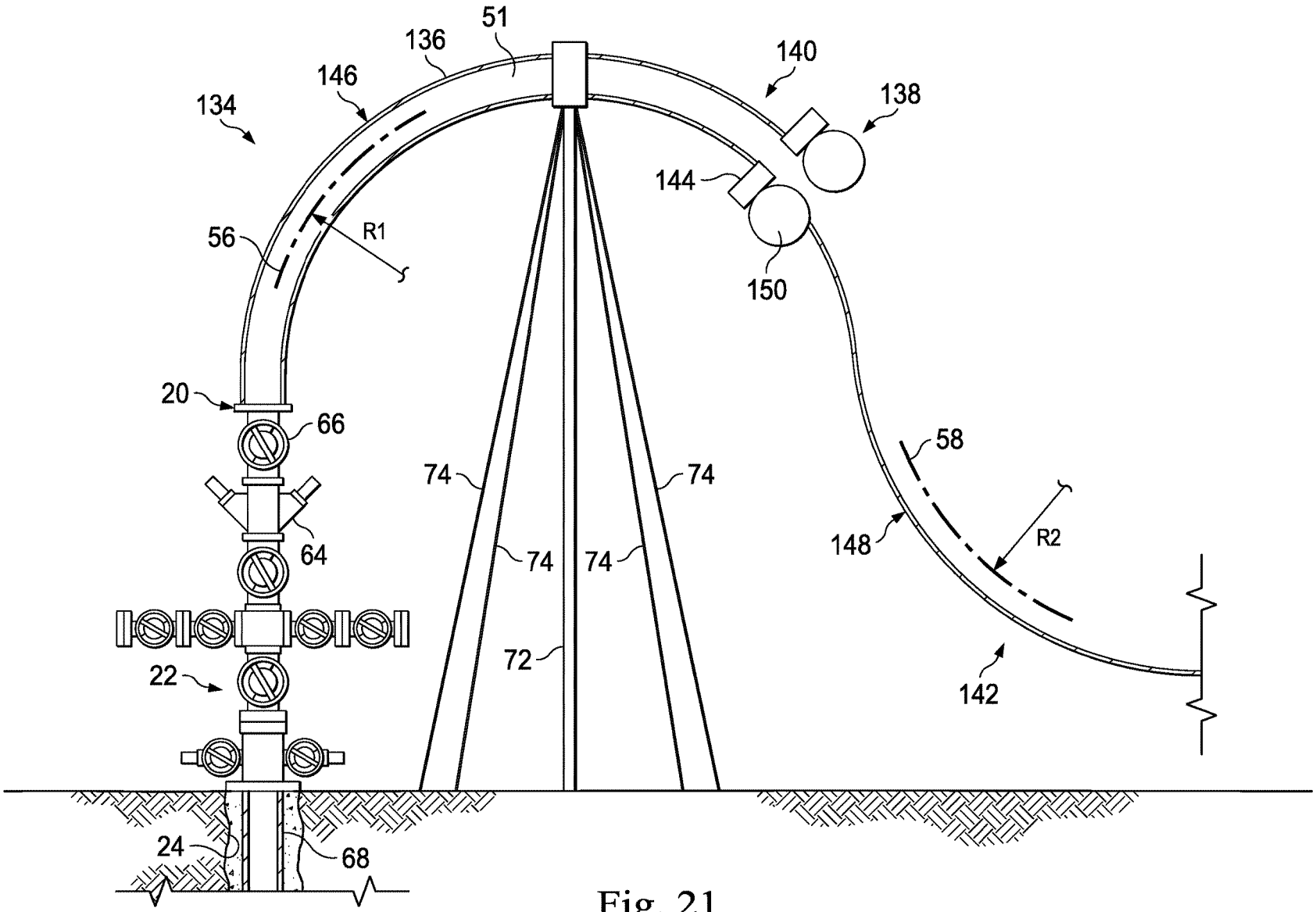
FIG. 21 is an elevational/schematic view of the fracturing tree, the wellhead, and an embodiment of the lubricator of FIG. 20, the lubricator including downwardly concave section, upwardly concave section, a tubular part, and an open part, according to one or more embodiments of the present disclosure.

Referring to FIGS. 20 and 21, a lubricator system is generally referred to by the reference numeral 134—the lubricator system 134 is substantially identical to the lubricator system 10, except that, instead of the lubricator 16 and the lubricator pump(s) 18, the lubricator system 134 includes a lubricator 136 and an injector 138. Therefore, in connection with FIGS. 20-25, parts of the lubricator system 134 that are substantially identical to corresponding parts of the lubricator system 10 are given the same reference numerals. Thus, the lubricator system 134 includes the conveyance truck 12, the downhole tool 14, the lubricator 136, and the injector 138—the lubricator system 134 is shown diagrammatically in FIG. 20. The lubricator 136 is connected to the frac tree 20. The frac tree 20 is connected to the wellhead 22 opposite the lubricator 136. The frac pump(s) 26 are connected to, and adapted to be in fluid communication with, the frac tree 20. The conveyance truck 12 includes the reel 28 on which the conveyance string 30 is coiled. The conveyance string 30 is connected to the downhole tool 14 opposite the reel 28. The injector 138 is connected to the lubricator 136 and adapted to engage the downhole tool 14, as will be described in further detail below. In some embodiments, the injector 138 is, or is adapted from, a coiled tubing type injector head.

Turning to FIG. 21, an embodiment of the lubricator system 134 is shown in which the lubricator 136 is substantially identical to the lubricator 16, except that, instead of the downwardly concave section 52, the upwardly concave section 54, and the end portion 60, the lubricator 136 includes a downwardly concave section 140, an upwardly concave section 142, and a sealing cap 144. In many respects, the downwardly concave section 140 and the upwardly concave section 142 are substantially identical to the downwardly concave section 52 and the upwardly concave section 54, respectively, and, therefore, in connection with FIGS. 21, 23, and 25, parts of the downwardly concave section 140 and the upwardly concave section 142 that are substantially identical to corresponding parts of the downwardly concave section 52 and the upwardly concave section 54 are given the same reference numerals. Thus, in some embodiments, the downwardly concave section 140 extends along the curvilinear axis 56 defining the radius R1, and the upwardly concave section 142 extends along the curvilinear axis 58 defining the radius R2. However, instead of being tubular along its entire length in a manner similar to the lubricator 16, the lubricator 136 includes a tubular part 146 and an open part 148 exposed to atmosphere.

The tubular part 146 of the lubricator 136 includes at least part of the downwardly concave section 140, and defines the internal passage 51. In some embodiments, the axis 56 of the downwardly concave section 140 at least partially forms or defines the curvilinear path along which the internal passage 51 of the lubricator 136 extends. The open part 148 of the lubricator 136 includes at least part of the upwardly concave section 142. The tubular part 146 of the lubricator 136 is adapted to be sealingly engaged by the sealing cap 144, as will be described in further detail below. The injector 138 is connected to the lubricator 136 adjacent the sealing cap 144 and adapted to inject the downhole tool 14 into the tubular part 146 via, for example, a pair of rollers 150. In some embodiments, the rollers 150 are also adapted to assist in the retrieval of the downhole tool 14 from the wellbore 24 and/or the wellhead 22 upon completion of, for example, the "plug-and-perf" operation.

Figure 22:
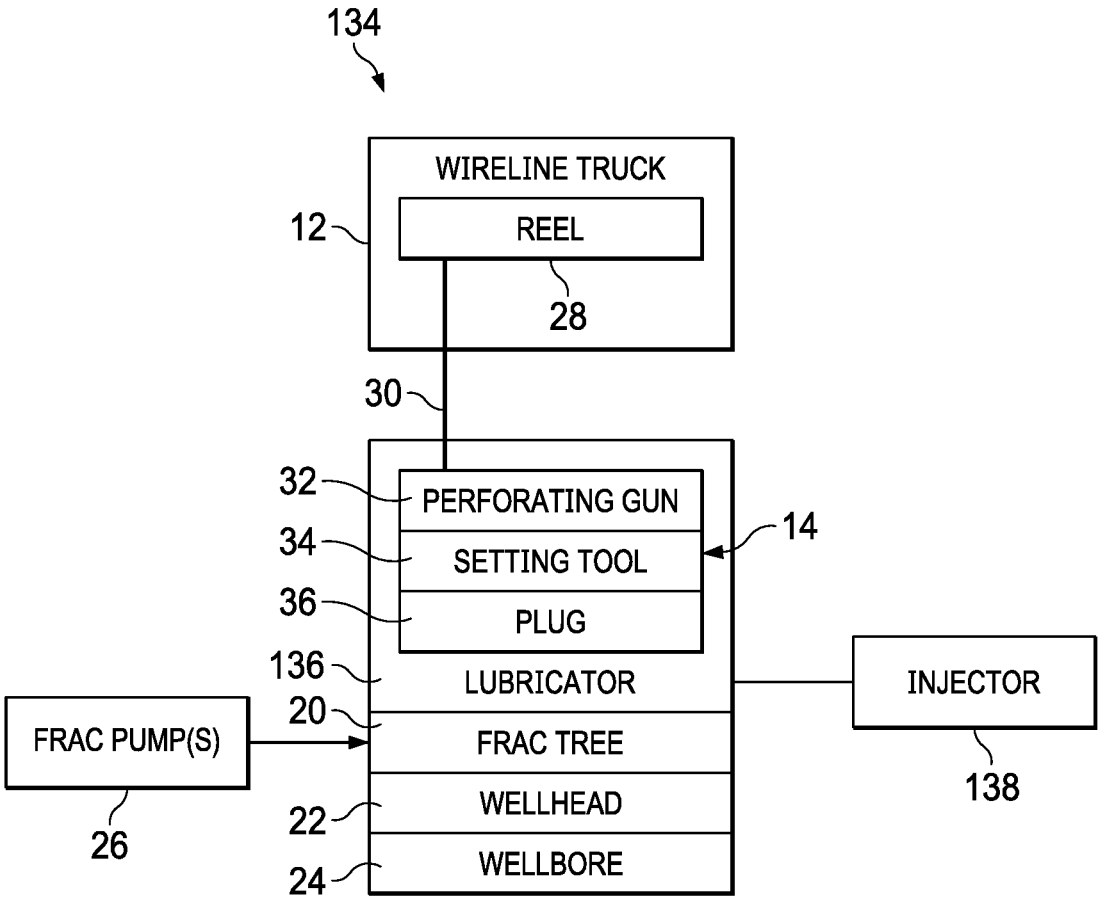
FIG. 22 is a diagrammatic illustration of the lubricator system of FIG. 20 in a first operational state in which the downhole tool extends within the lubricator, according to one or more embodiments of the present disclosure.
Figure 23:
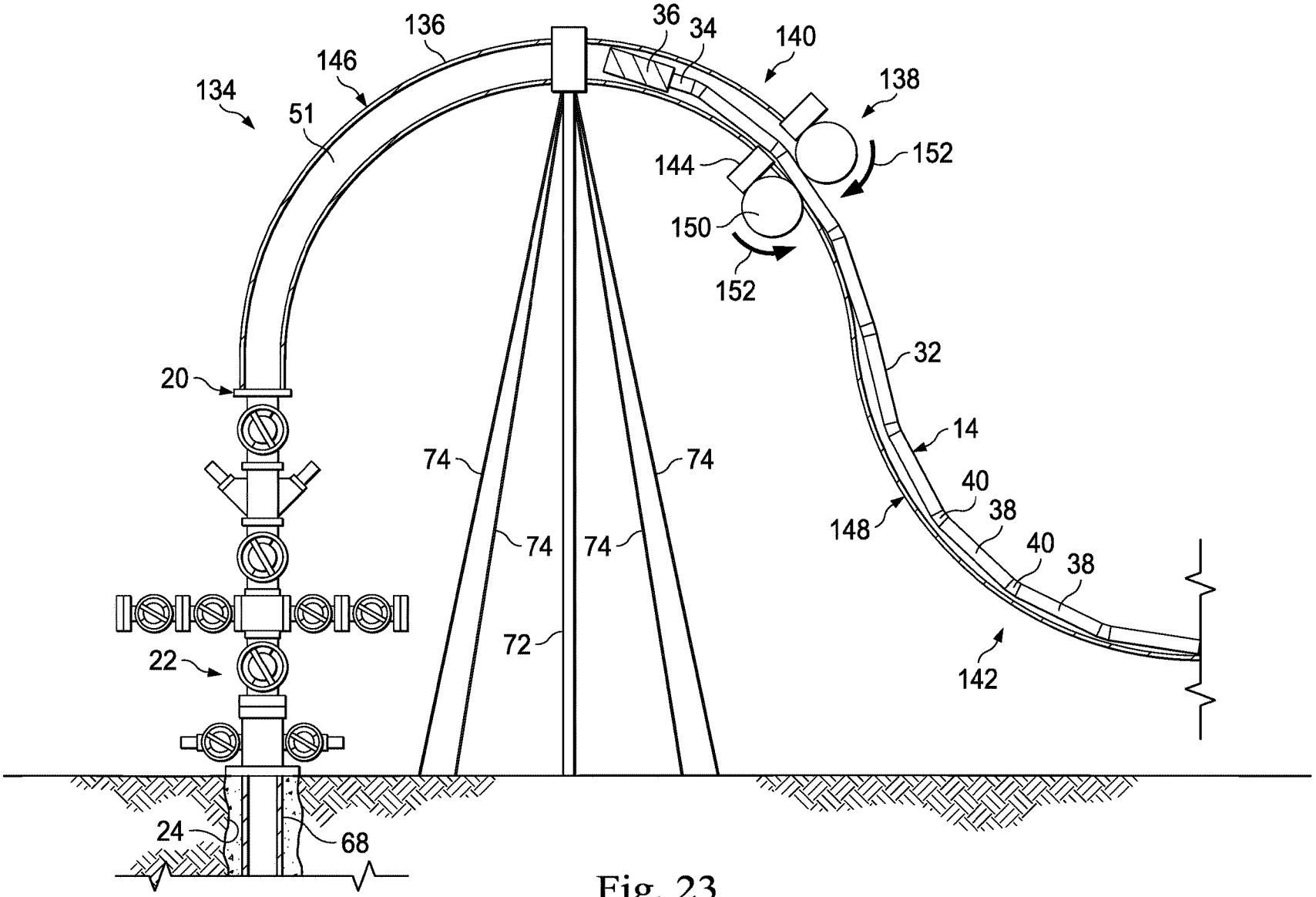
FIG. 23 is an elevational/schematic view in partial cross section of an embodiment of the first operational state illustrated in FIG. 22, according to one or more embodiments of the present disclosure.

Referring to FIGS. 22 and 23, the lubricator system 134 is illustrated in a first operational state in which the downhole tool 14 is positioned within the lubricator 136—the first operational state of the lubricator system 134 is shown diagrammatically in FIG. 22. The conveyance string 30 is connected to the downhole tool 14 and extends out of the lubricator 136 to the reel 28 on the conveyance truck 12. The injector 138 engages the downhole tool 14. In the first operational state of the lubricator system 134, the injector 138 is adapted to engage the downhole tool 14 in a manner that causes the downhole tool 14 to move through the lubricator 136 toward the frac tree 20.

Turning to FIG. 23, an embodiment of the first operational state of the lubricator system 134 is shown in which part of the downhole tool 14 extends within the tubular part 146 of the lubricator 136 and part of the downhole tool 14 is supported along the open part 148 of the lubricator 136. As a result, in the first operational state of the lubricator system 134, the downhole tool 14 extends along the downwardly concave section 140 and the upwardly concave section 142 of the lubricator 136. To enable the extension of the downhole tool 14 along the downwardly concave section 140 and the upwardly concave section 142 of the lubricator 136, the downhole tool 14 pivots about the axes 44 and 46 (shown in FIG. 2) via the pivot joints 40—such pivoting generally aligns the downhole tool 14 with the curvilinear axes 56 and 58 of the lubricator 136. In the first operational state of the lubricator system 134, the sealing cap 144 is not sealingly engaged with the tubular part 146 of the lubricator 136, but is rather disengaged so as to allow passage of the downhole tool 14 into the tubular part 146 of the lubricator 136. Moreover, the rollers 150 of the injector 138 are adapted to engage the downhole tool 14, as indicated by curvilinear arrows 152, in a manner that causes the downhole tool 14 to move through the lubricator 136 toward the frac tree 20.

Figure 24:
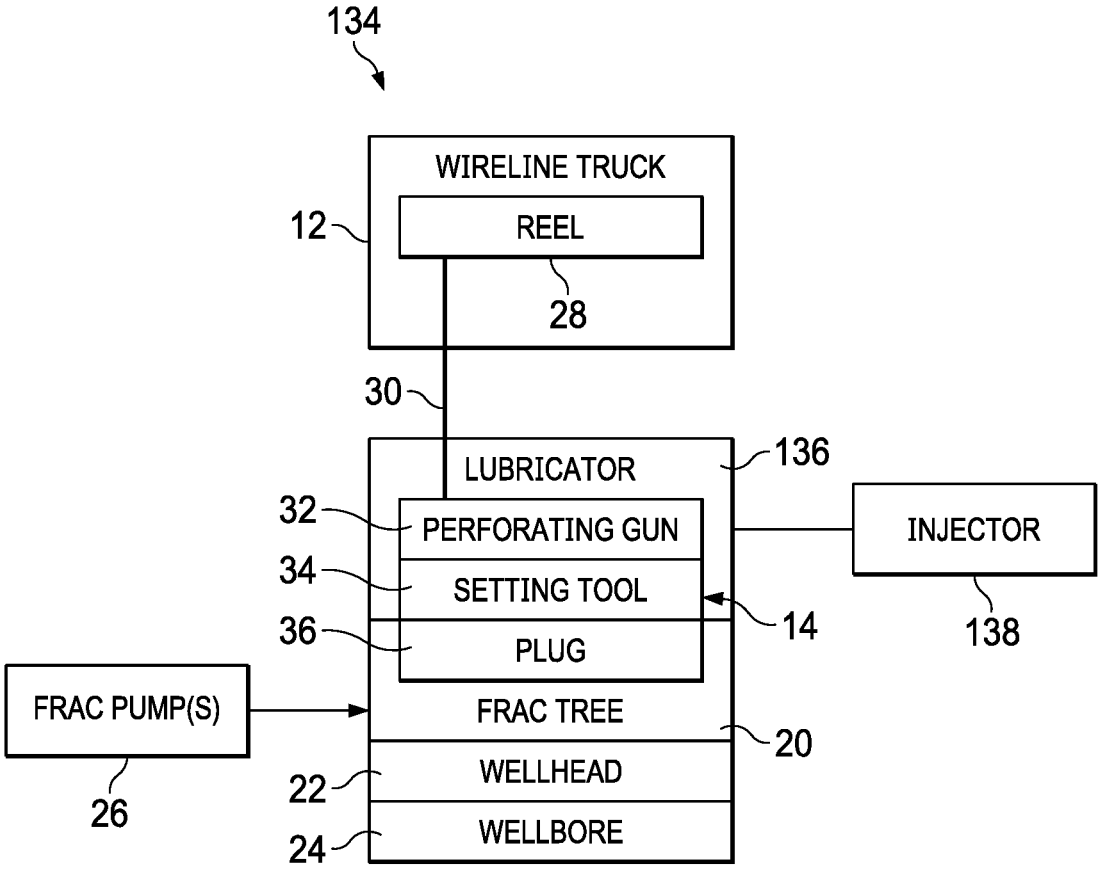
FIG. 24 is a diagrammatic illustration of the lubricator system of FIG. 20 in a second operational state in which the downhole tool extends within the lubricator and the fracturing tree, according to one or more embodiments of the present disclosure.
Figure 25:
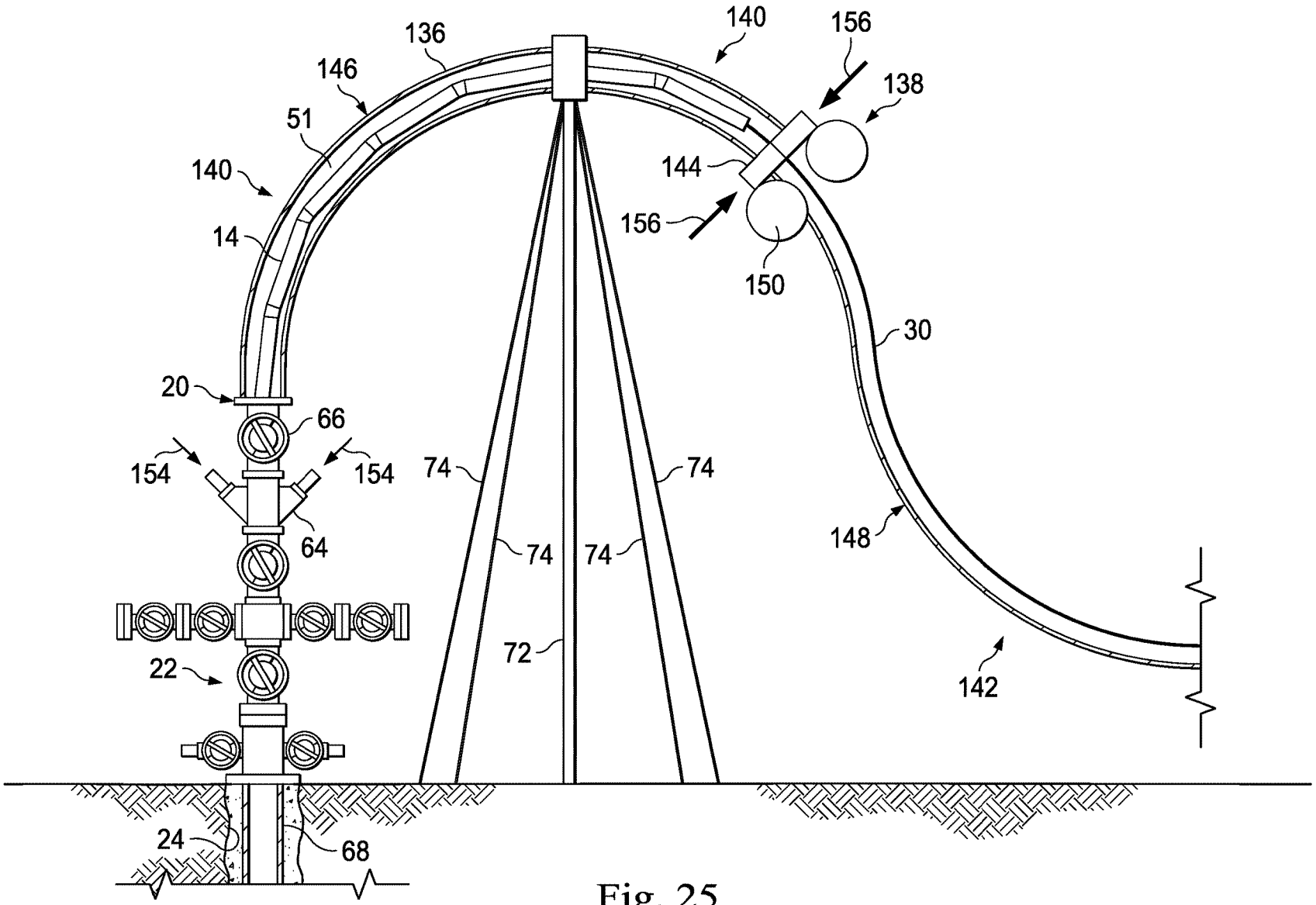
FIG. 25 is an elevational/schematic view in partial cross section of an embodiment of the second operational state illustrated in FIG. 24, according to one or more embodiments of the present disclosure.

Referring to FIGS. 24 and 25, the lubricator system 134 is illustrated in a second operational state in which part of the downhole tool 14 extends within the frac tree 20—the second operational state of the lubricator system 134 is illustrated diagrammatically in FIG. 24. To actuate the lubricator system 134 from the first operational state to the second operational state, the injector 138 engages the downhole tool 14 in a manner that causes the downhole tool 14 to move through the lubricator 136 toward the frac tree 20, as described above. In the second operational state of the lubricator system 134, the frac pump(s) 26 are adapted to pump fluid into the frac tree 20 behind the plug 36 to thereby create a pressure differential across the plug 36. The pressure differential across the plug 36 urges the downhole tool 14 through the frac tree 20 and the wellhead 22 like a piston so that, as the conveyance string 30 is unwound from the reel 28, the downhole tool 14 moves through the frac tree 20 and the wellhead 22 toward the wellbore 24.

Turning to FIG. 25, an embodiment of the second operational state of the lubricator system 134 is shown in which the frac pump(s) 26 are connected to the goat head 64 and adapted to pump fluid into the frac tree 20 behind the plug 36 to thereby create the pressure differential across the plug 36, as indicated by arrows 154. The downhole tool 14 extends within the tubular part 146 of the lubricator 136, but not within the open part 148 of the lubricator 136. As a result, the downhole tool 14 extends along the downwardly concave section 140 of the lubricator 136. The sealing cap 144 is sealingly engaged with the tubular part 146 of the lubricator 136, as indicated by arrows 156—when so sealingly engaged with the tubular part 146 of the lubricator 136, the sealing cap 144 also sealingly engages the conveyance string 30 to prevent, or at least reduce, leakage of fluid from inside the tubular part 146 of the lubricator 136 to atmosphere. The radial clearance between the plug 36 and the lubricator 136 is less than the radial clearance between the setting tool 34 and the lubricator 136, and is less than the radial clearance between the perforating gun 32 and the lubricator 136—this reduced clearance enables the pressure differential to be created across the plug 36. The sealing engagement of the sealing cap 144 with conveyance string 30 and the tubular part 146 of the lubricator 136 holds backpressure caused by the pumping of fluid into the goat head 64 by the frac pump(s) 26, thereby enabling the pressure differential to be created across the plug 36. The pressure differential across the plug 36 urges the downhole tool 14 through the frac tree 20 and the wellhead 22 like a piston so that, as the conveyance string 30 is unwound from the reel 28, the downhole tool 14 moves through the frac tree 20 and the wellhead 22 toward the wellbore 24.

Figure 26:
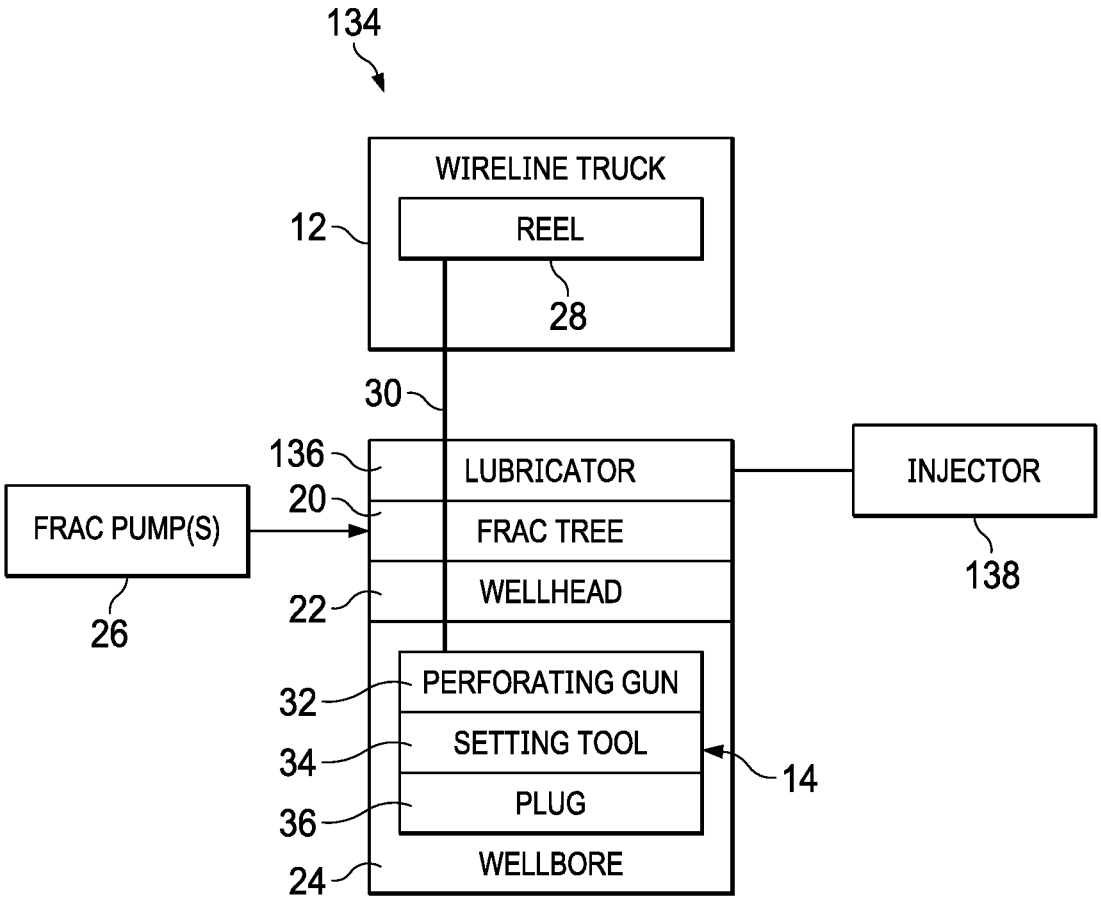
FIG. 26 is a diagrammatic illustration of the lubricator system of FIG. 20 in a third operational state in which the downhole tool extends within the wellbore, according to one or more embodiments of the present disclosure.

Referring to FIG. 26, the lubricator system 134 is illustrated in a third operational state in which the downhole tool 14 is positioned within the wellbore 24—the third operational state of the lubricator system 134 is shown diagrammatically in FIG. 26. The conveyance string 30 is connected to the downhole tool 14 and extends through the wellbore 24, the wellhead 22, the frac tree 20, and the lubricator 136 to the reel 28 on the conveyance string 30 truck. To actuate the lubricator system 134 from the second operational state to the third operational state, the frac pump(s) 26 pump fluid into the frac tree 20 behind the plug 36 so that, as the conveyance string 30 is unwound from the reel 28, the downhole tool 14 moves through the frac tree 20 and the wellhead 22 toward the wellbore 24, as described above. Many aspects of the third operational state of the lubricator system 134 are substantially identical to the third operational state of the lubricator system 10—at least some of these substantially identical aspects can be seen by referring again to FIGS. 10(*a*)-(*c*). Therefore, the third operational state of the lubricator system 134 will not be described in further detail. Moreover, in some embodiments, the lubricator system 134 includes the orienting device 90 adapted to ensure proper orientation of the downhole tool 14 relative to the lubricator 136 upon re-entry of the downhole tool 14 into the lubricator 136 from the wellbore 24. The orienting device 90 is described above in connection with FIGS. 11, 12(*a*), and 12(*b*), and, therefore, will not be described in further detail.

Figure 27:
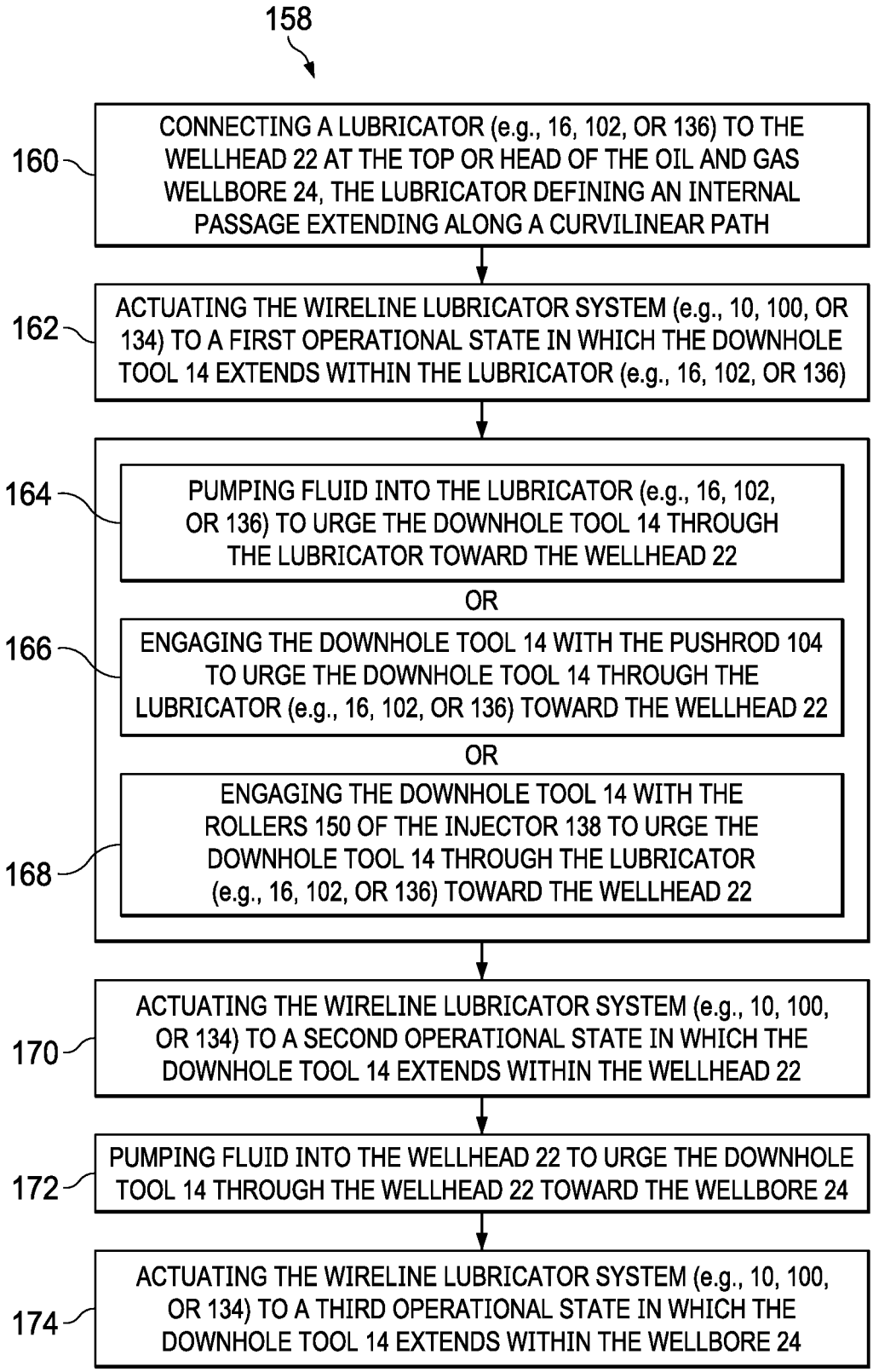
FIG. 27 is a flowchart illustration of a method of using a lubricator system, according to one or more embodiments of the present disclosure.

Referring to FIG. 27, a method of using the lubricator system (e.g., 10, 100, or 134) is generally referred to by the reference numeral 158. The method 158 includes connecting a lubricator (e.g., 16, 102, or 136) to the wellhead 22 at the top or head of the oil and gas wellbore 24 at a step 160, the lubricator defining an internal passage extending along a curvilinear path. In some embodiments, the lubricator (e.g., 16, 102, or 136) includes a downwardly concave section (e.g., 52 or 140) extending along the curvilinear axis 56 and an upwardly concave section (e.g., 54 or 142) extending along the curvilinear axis 58. The method 158 also includes actuating the lubricator system (e.g., 10, 100, or 134) to a first operational state in which the downhole tool 14 extends within the lubricator (e.g., 16, 102, or 136) at a step 162. In some embodiments, the step 162 of actuating the lubricator system (e.g., 10, 100, or 134) to a first operational state includes generally aligning the downhole tool 14 with the curvilinear axes (e.g., 52 and 54, or 140 and 142) using the pivot joints (e.g., 40), the pivot joints being interposed between respective portions of the downhole tool 14. After the lubricator system (e.g., 10, 100, or 134) is actuated to the first operational state at the step 162, the method 158 includes one of the following: pumping fluid into the lubricator (e.g., 16, 102, or 136) to urge the downhole tool 14 through the lubricator toward the wellhead 22 at a step 164; engaging the downhole tool 14 with the pushrod 104 to urge the downhole tool 14 through the lubricator (e.g., 16, 102, or 136) toward the wellhead 22 at a step 166; or engaging the downhole tool 14 with the rollers 150 of the injector 138 to urge the downhole tool 14 through the lubricator (e.g., 16, 102, or 136) toward the wellhead 22 at a step 168.

In addition, the method 158 also includes actuating the lubricator system (e.g., 10, 100, or 134) to a second operational state in which the downhole tool 14 extends within the wellhead 22 at a step 170, and, after the lubricator system (e.g., 10, 100, or 134) is actuated to the second operational state, pumping fluid into the wellhead 22 to urge the downhole tool 14 through the wellhead 22 toward the wellbore 24 at a step 172. In some embodiments, the step 170 of actuating the lubricator system (e.g., 10, 100, or 134) to the second operational state includes connecting the conveyance string 30 to the downhole tool 14 so that the conveyance string 30 extends out of the lubricator (e.g., 16, 102, or 136), and sealingly engaging the conveyance string 30 with the sealing cap (e.g., 76, 130, or 144) so that, when the fluid is pumped into the wellhead 22, the sealing cap holds backpressure of the pumped fluid in the lubricator (e.g., 16, 102, or 136). Finally, the method 158 includes actuating the lubricator system (e.g., 10, 100, or 134) to a third operational state in which the downhole tool 14 extends within the wellbore 24 at a step 174.

In some embodiments, the lubricator system 10, 100, or 134 eliminates the need for a crane to suspend the lubricator (e.g., 16, 102, or 136), thereby decreasing cost, increasing safety, and eliminating downtime usually caused by wind conditions.

The present disclosure introduces a method, including connecting a lubricator to a wellhead at the top or head of an oil and gas wellbore, the lubricator defining an internal passage extending along a curvilinear path; and conveying, through the internal passage of the lubricator and along the curvilinear path, a downhole tool in combination with a conveyance string connected to the downhole tool; wherein the lubricator includes a downwardly concave section extending along a first curvilinear axis, the downwardly concave section defining a first portion of the internal passage, and the first curvilinear axis at least partially forming or defining the curvilinear path along which the internal passage extends. In some embodiments, the lubricator further includes an upwardly concave section extending along a second curvilinear axis, the upwardly concave section defining a second portion of the internal passage; and the first and second curvilinear axes at least partially form or define the curvilinear path along which the internal passage extends. In some embodiments, the first curvilinear axis defines a first radius and the second curvilinear axis defines a second radius, the second radius being substantially equal to the first radius. In some embodiments, conveying, through the internal passage of the lubricator and along the curvilinear path, the downhole tool and the conveyance string connected to the downhole tool includes generally aligning the downhole tool with the first curvilinear axis using pivot joints, the pivot joints being interposed between respective portions of the downhole tool. In some embodiments, conveying, through the internal passage of the lubricator and along the curvilinear path, the downhole tool and the conveyance string connected to the downhole tool includes conveying the downhole tool and the conveyance string connected to the downhole tool so that the downhole tool extends within the lubricator. In some embodiments, conveying, through the internal passage of the lubricator and along the curvilinear path, the downhole tool and the conveyance string connected to the downhole tool further includes during or after conveying the downhole tool and the conveyance string connected to the downhole tool so that the downhole tool extends within the lubricator, pumping fluid into the lubricator to urge the downhole tool through the lubricator toward the wellhead. In some embodiments, conveying, through the internal passage of the lubricator and along the curvilinear path, the downhole tool and the conveyance string connected to the downhole tool further includes during or after conveying the downhole tool and the conveyance string connected to the downhole tool so that the downhole tool extends within the lubricator, engaging the downhole tool with a pushrod to urge the downhole tool through the lubricator toward the wellhead. In some embodiments, conveying, through the internal passage of the lubricator and along the curvilinear path, the downhole tool and the conveyance string connected to the downhole tool further includes during or after conveying the downhole tool and the conveyance string connected to the downhole tool so that the downhole tool extends within the lubricator, engaging the downhole tool with one or more rollers of an injector to urge the downhole tool through the lubricator toward the wellhead. In some embodiments, conveying, through the internal passage of the lubricator and along the curvilinear path, the downhole tool and the conveyance string connected to the downhole tool further includes conveying the downhole tool and the conveyance string connected to the downhole tool so that the downhole tool extends within the wellhead; and during or after conveying the downhole tool and the conveyance string connected to the downhole tool so that the downhole tool extends within the wellhead, pumping fluid into the wellhead to urge the downhole tool through the wellhead toward the wellbore. In some embodiments, conveying, through the internal passage of the lubricator and along the curvilinear path, the downhole tool and the conveyance string connected to the downhole tool further includes during or after conveying the downhole tool and the conveyance string connected to the downhole tool so that the downhole tool extends within the wellhead, pumping fluid into the wellhead to urge the downhole tool through the wellhead toward the wellbore. In some embodiments, conveying, through the internal passage of the lubricator and along the curvilinear path, the downhole tool and the conveyance string connected to the downhole tool further includes sealingly engaging the conveyance string with a sealing cap so that, when the fluid is pumped into the wellhead, the sealing cap holds backpressure of the pumped fluid in the lubricator. In some embodiments, conveying, through the internal passage of the lubricator and along the curvilinear path, the downhole tool and the conveyance string connected to the downhole tool further includes conveying the downhole tool and the conveyance string connected to the downhole tool so that the downhole tool extends within the wellbore. In some embodiments, the downhole tool includes: a plug; a setting tool connected to the plug; and a perforating gun connected to the setting tool, the perforating gun including a plurality of perforator segments; a plurality of first pivot joints, each of the first pivot joints being interposed between respective ones of the perforator segments; and a second pivot joint interposed between the setting tool and one of the perforator segments; and wherein conveying, through the internal passage of the lubricator and along the curvilinear path, the downhole tool and the conveyance string connected to the downhole tool includes generally aligning the downhole tool with the first curvilinear axis using the second pivot joint and the plurality of first pivot joints.

The present disclosure also introduces a lubricator system, including a lubricator defining an internal passage extending along a curvilinear path, the lubricator being configured to be connected to a wellhead at the top or head of an oil and gas wellbore; a downhole tool; and a conveyance string configured to be connected to the downhole tool; wherein the downhole tool and the conveyance string, in combination, are configured to be conveyed through the internal passage of the lubricator and along the curvilinear path; and wherein the lubricator includes a downwardly concave section extending along a first curvilinear axis, the downwardly concave section defining a first portion of the internal passage, and the first curvilinear axis at least partially forming or defining the curvilinear path along which the internal passage extends. In some embodiments, the lubricator further includes an upwardly concave section extending along a second curvilinear axis, the upwardly concave section defining a second portion of the internal passage; and the first and second curvilinear axes at least partially form or define the curvilinear path along which the internal passage extends. In some embodiments, the first curvilinear axis defines a first radius and the second curvilinear axis defines a second radius, the second radius being substantially equal to the first radius. In some embodiments, the downhole tool includes pivot joints interposed between respective portions thereof to enable general alignment of the downhole tool with the first curvilinear axis when the downhole tool and the conveyance string, in combination, are conveyed through the internal passage of the lubricator and along the curvilinear path. In some embodiments, the lubricator system is actuable to a first operational state in which the downhole tool extends within the lubricator. In some embodiments, in the first operational state, fluid is configured to be pumped into the lubricator to urge the downhole tool through the lubricator toward the wellhead. In some embodiments, in the first operational state, a pushrod is configured to engage the downhole tool to urge the downhole tool through the lubricator toward the wellhead. In some embodiments, the lubricator system further includes an injector, the injector including one or more rollers; wherein, in the first operational state, each of the one or more rollers is configured to engage the downhole tool to urge the downhole tool through the lubricator toward the wellhead. In some embodiments, the lubricator system is actuable to a second operational state in which the downhole tool extends within the wellhead; and the lubricator system is actuable to a third operational state in which the downhole tool extends within the wellbore. In some embodiments, in the second operational state: fluid is configured to be pumped into the wellhead to urge the downhole tool through the wellhead toward the wellbore; and the conveyance string is connected to the downhole tool and extends out of the lubricator, and a sealing cap sealingly engages the conveyance string so that, when the fluid is pumped into the wellhead, the sealing cap holds backpressure of the pumped fluid in the lubricator. In some embodiments, the downhole tool includes: a plug; a setting tool connected to the plug; and a perforating gun connected to the setting tool, the perforating gun including a plurality of perforator segments, a plurality of first pivot joints, each of the first pivot joints being interposed between respective ones of the perforator segments, and a second pivot joint interposed between the setting tool and one of the perforator segments; wherein the second pivot joint and the plurality of first pivot joints are configured to generally align the downhole tool with the first curvilinear axis so that the downhole tool, in combination with the conveyance string, is permitted to be conveyed through the internal passage of the lubricator and along the curvilinear path.

The present disclosure also introduces a lubricator system, including a lubricator defining an internal passage extending along a curvilinear path, the lubricator being adapted to be connected to a wellhead at the top or head of an oil and gas wellbore; wherein the lubricator includes a downwardly concave section extending along a first curvilinear axis, the downwardly concave section defining a first portion of the internal passage; wherein the lubricator system is actuable to a first operational state in which a downhole tool and a conveyance string connected thereto extend within the downwardly concave section of the lubricator; and wherein the first portion of the internal passage of the lubricator is configured to permit the downhole tool and the conveyance string connected thereto to extend within the downwardly concave section of the lubricator when the lubricator system is in the first operational state. In some embodiments, the lubricator further includes an upwardly concave section extending along a second curvilinear axis, the upwardly concave section defining a second portion of the internal passage. In some embodiments, in the first operational state: (a) fluid is adapted to be pumped into the lubricator to urge the downhole tool through the lubricator toward the wellhead; (b) a pushrod is adapted to engage the downhole tool to urge the downhole tool through the lubricator toward the wellhead; (c) an injector including one or more rollers is adapted to engage the downhole tool to urge the downhole tool through the lubricator toward the wellhead; or any combination of (a), (b), and (c). In some embodiments, the lubricator system is actuable to: a second operational state in which the downhole tool extends within the wellhead; and a third operational state in which the downhole tool extends within the wellbore. In some embodiments, the lubricator system further includes the downhole tool and the conveyance string connected thereto. In some embodiments, the conveyance string is, or includes, a wireline; wherein the lubricator system further includes a sealing cap adapted to sealingly engage the wireline; and wherein, in the second operational state: fluid is adapted to be pumped into the wellhead to urge the downhole tool through the wellhead toward the wellbore, the wireline extends out of the lubricator, and the sealing cap sealingly engages the wireline so that, when the fluid is pumped into the wellhead, the sealing cap holds backpressure of the pumped fluid in the lubricator.

It is understood that variations may be made in the foregoing without departing from the scope of the present disclosure.

In some embodiments, the elements and teachings of the various embodiments may be combined in whole or in part in some or all of the embodiments. In addition, one or more of the elements and teachings of the various embodiments may be omitted, at least in part, and/or combined, at least in part, with one or more of the other elements and teachings of the various embodiments.

Any spatial references, such as, for example, "upper," "lower," "above," "below," "between," "bottom," "vertical," "horizontal," "angular," "upwards," "downwards," "side-to-side," "left-to-right," "right-to-left," "top-to-bottom," "bottom-to-top," "top," "bottom," "bottom-up," "top-down," etc., are for the purpose of illustration only and do not limit the specific orientation or location of the structure described above.

In some embodiments, while different steps, processes, and procedures are described as appearing as distinct acts, one or more of the steps, one or more of the processes, and/or one or more of the procedures may also be performed in different orders, simultaneously and/or sequentially. In some embodiments, the steps, processes, and/or procedures may be merged into one or more steps, processes and/or procedures.

In some embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Although some embodiments have been described in detail above, the embodiments described are illustrative only and are not limiting, and those skilled in the art will readily appreciate that many other modifications, changes and/or substitutions are possible in the embodiments without materially departing from the novel teachings and advantages of the present disclosure. Accordingly, all such modifications, changes, and/or substitutions are intended to be included within the scope of this disclosure as defined in the following claims. In the claims, any means-plus-function clauses are intended to cover the structures described herein as performing the recited function and not only structural equivalents, but also equivalent structures. Moreover, it is the express intention of the applicant not to invoke 35 U.S.C. § 112, paragraph 6 for any limitations of any of the claims herein, except for those in which the claim expressly uses the word "means" together with an associated function.

What is claimed is:

1. A method, comprising:

connecting a lubricator to a wellhead at the top or head of an oil and gas wellbore, the lubricator defining an internal passage extending along a curvilinear path;

wherein the lubricator includes a downwardly concave section extending along a first curvilinear axis, the downwardly concave section defining a first portion of the internal passage, and the first curvilinear axis at least partially forming or defining the curvilinear path along which the internal passage extends; and wherein the first curvilinear axis along which the downwardly concave section of the lubricator extends subtends a central angle of equal to or greater than 90 degrees and equal to or less than 180 degrees.

2. The method of claim 1, wherein the lubricator further includes an upwardly concave section extending along a second curvilinear axis, the upwardly concave section defining a second portion of the internal passage; and wherein the first and second curvilinear axes at least partially form or define the curvilinear path along which the internal passage extends.

3. The method of claim 2, wherein the first curvilinear axis defines a first radius and the second curvilinear axis defines a second radius, the second radius being substantially equal to the first radius.

4. The method of claim 1, further comprising:

conveying, through the internal passage of the lubricator and along the curvilinear path, a downhole tool in combination with a conveyance string connected to the downhole tool.

5. The method of claim 4, wherein conveying, through the internal passage of the lubricator and along the curvilinear path, the downhole tool and the conveyance string connected to the downhole tool comprises:

generally aligning the downhole tool with the first curvilinear axis using pivot joints, the pivot joints being interposed between respective portions of the downhole tool.

6. The method of claim 4, wherein conveying, through the internal passage of the lubricator and along the curvilinear path, the downhole tool and the conveyance string connected to the downhole tool comprises:

conveying the downhole tool and the conveyance string connected to the downhole tool so that the downhole tool extends within the lubricator.

7. The method of claim 6, wherein conveying, through the internal passage of the lubricator and along the curvilinear path, the downhole tool and the conveyance string connected to the downhole tool further comprises:

during or after conveying the downhole tool and the conveyance string connected to the downhole tool so that the downhole tool extends within the lubricator, pumping fluid into the lubricator to urge the downhole tool through the lubricator toward the wellhead.

8. The method of claim 6, wherein conveying, through the internal passage of the lubricator and along the curvilinear path, the downhole tool and the conveyance string connected to the downhole tool further comprises:

during or after conveying the downhole tool and the conveyance string connected to the downhole tool so that the downhole tool extends within the lubricator, engaging the downhole tool with a pushrod to urge the downhole tool through the lubricator toward the wellhead.

9. The method of claim 6, wherein conveying, through the internal passage of the lubricator and along the curvilinear path, the downhole tool and the conveyance string connected to the downhole tool further comprises:

during or after conveying the downhole tool and the conveyance string connected to the downhole tool so that the downhole tool extends within the lubricator, engaging the downhole tool with one or more rollers of an injector to urge the downhole tool through the lubricator toward the wellhead.

10. The method of claim 6, wherein conveying, through the internal passage of the lubricator and along the curvilinear path, the downhole tool and the conveyance string connected to the downhole tool further comprises:

conveying the downhole tool and the conveyance string connected to the downhole tool so that the downhole tool extends within the wellhead.

11. The method of claim 10, wherein conveying, through the internal passage of the lubricator and along the curvilinear path, the downhole tool and the conveyance string connected to the downhole tool further comprises:

during or after conveying the downhole tool and the conveyance string connected to the downhole tool so that the downhole tool extends within the wellhead, pumping fluid into the wellhead to urge the downhole tool through the wellhead toward the wellbore.

12. The method of claim 11, wherein conveying, through the internal passage of the lubricator and along the curvilinear path, the downhole tool and the conveyance string connected to the downhole tool further comprises:

sealingly engaging the conveyance string with a sealing cap so that, when the fluid is pumped into the wellhead, the sealing cap holds backpressure of the pumped fluid in the lubricator.

13. The method of claim 10, wherein conveying, through the internal passage of the lubricator and along the curvilinear path, the downhole tool and the conveyance string connected to the downhole tool further comprises:

conveying the downhole tool and the conveyance string connected to the downhole tool so that the downhole tool extends within the wellbore.

14. The method of claim 4, wherein the downhole tool comprises:

a plug;

a setting tool connected to the plug; and a perforating gun connected to the setting tool, the perforating gun comprising:

a plurality of perforator segments;

a plurality of first pivot joints, each of the first pivot joints being interposed between respective ones of the perforator segments; and a second pivot joint interposed between the setting tool and one of the perforator segments;

and wherein conveying, through the internal passage of the lubricator and along the curvilinear path, the downhole tool and the conveyance string connected to the downhole tool includes generally aligning the downhole tool with the first curvilinear axis using the second pivot joint and the plurality of first pivot joints.

15. The method of claim 4, further comprising:

accommodating, using a plurality of eyelets spaced along the lubricator, the conveyance string to prevent, or at least reduce, wear or erosion caused by contact between the conveyance string and the lubricator.

16. The method of claim 15, wherein conveying, through the internal passage of the lubricator and along the curvilinear path, the downhole tool in combination with the conveyance string connected to the downhole tool comprises:

engaging the downhole tool with a pushrod to urge the downhole tool through the lubricator toward the wellhead;

wherein the eyelets are connected to the pushrod.

17. A lubricator system, comprising:

a lubricator defining an internal passage extending along a curvilinear path, the lubricator being configured to be connected to a wellhead at the top or head of an oil and gas wellbore;

wherein the lubricator includes a downwardly concave section extending along a first curvilinear axis, the downwardly concave section defining a first portion of the internal passage, and the first curvilinear axis at least partially forming or defining the curvilinear path along which the internal passage extends; and wherein the first curvilinear axis along which the downwardly concave section of the lubricator extends subtends a central angle of equal to or greater than 90 degrees and equal to or less than 180 degrees.

18. The lubricator system of claim 17, wherein the lubricator further includes an upwardly concave section extending along a second curvilinear axis, the upwardly concave section defining a second portion of the internal passage; and wherein the first and second curvilinear axes at least partially form or define the curvilinear path along which the internal passage extends.

19. The lubricator system of claim 18, wherein the first curvilinear axis defines a first radius and the second curvilinear axis defines a second radius, the second radius being substantially equal to the first radius.

20. The lubricator system of claim 17, further comprising:

a downhole tool; and a conveyance string.

21. The lubricator system of claim 20, wherein the downhole tool and the conveyance string, in combination, are configured to be conveyed through the internal passage of the lubricator and along the curvilinear path; and wherein the downhole tool includes pivot joints interposed between respective portions thereof to enable general alignment of the downhole tool with the first curvilinear axis when the downhole tool and the conveyance string, in combination, are conveyed through the internal passage of the lubricator and along the curvilinear path.

22. The lubricator system of claim 20, wherein the lubricator system is actuable to a first operational state in which the downhole tool extends within the lubricator.

23. The lubricator system of claim 22, wherein, in the first operational state, fluid is configured to be pumped into the lubricator to urge the downhole tool through the lubricator toward the wellhead.

24. The lubricator system of claim 22, wherein, in the first operational state, a pushrod is configured to engage the downhole tool to urge the downhole tool through the lubricator toward the wellhead.

25. The lubricator system of claim 17, further comprising:

a plurality of eyelets spaced along the lubricator and adapted to accommodate the conveyance string to prevent, or at least reduce, wear or erosion caused by contact between the conveyance string and the lubricator.

26. The lubricator system of claim 25, further comprising:

a pushrod configured to engage the downhole tool to urge the downhole tool through the lubricator toward the wellhead;

wherein the eyelets are connected to the pushrod.

* * * * *